US009140482B2

(12) United States Patent
Popovitch et al.

(10) Patent No.: US 9,140,482 B2
(45) Date of Patent: Sep. 22, 2015

(54) REMOVABLE STORAGE BASKET AND ASSOCIATED METHODS FOR STORING ITEMS WITHIN A FREEZER

(71) Applicant: Thermo Fisher Scientific (Asheville) LLC, Asheville, NC (US)

(72) Inventors: Lou Spencer Popovitch, Asheville, NC (US); Christopher Enright Bruchs, Asheville, NC (US); Dan Joseph Mangan, Asheville, NC (US)

(73) Assignee: Thermo Fisher Scientific (Asheville) LLC, Ashville, NC (US)

( * ) Notice: Subject to any disclaimer, the term of this patent is extended or adjusted under 35 U.S.C. 154(b) by 48 days.

(21) Appl. No.: 14/041,072

(22) Filed: Sep. 30, 2013

(65) Prior Publication Data

US 2015/0091430 A1 Apr. 2, 2015

(51) Int. Cl.
*F25D 25/02* (2006.01)

(52) U.S. Cl.
CPC ..... *F25D 25/022* (2013.01); *F25D 25/02* (2013.01); *F25D 25/021* (2013.01); *F25D 25/028* (2013.01); *F25D 2331/8014* (2013.01)

(58) Field of Classification Search
CPC ..... A61B 19/0248; A61B 2019/0254; B65D 77/046; B65D 2577/043; F25D 25/025; F25D 23/005; F25D 25/002; F25D 25/021; A47B 2210/175; A47B 2031/003; A47B 96/027; A47B 57/583; A47B 45/00; A47F 3/04; A47F 3/046; A47F 3/14; A47F 3/06
USPC ..... 211/128.1, 52, 55, 153, 90.01, 90.04, 211/126.15; 220/503, 507, 509, 516, 553, 220/555, 755, 772; 312/35, 36, 116, 126, 312/128, 404, 408, 330.1, 351; 108/94
See application file for complete search history.

(56) References Cited

U.S. PATENT DOCUMENTS

| | | | | | |
|---|---|---|---|---|---|
| 1,518,277 | A | | 12/1924 | Sayford | |
| 1,609,945 | A | * | 12/1926 | Hermani | 211/135 |
| 1,672,633 | A | * | 6/1928 | Vogel | 211/55 |
| 2,049,279 | A | * | 7/1936 | Voorhees | 211/128.1 |
| 2,050,063 | A | * | 8/1936 | Millott | 62/251 |
| 2,103,241 | A | * | 12/1937 | Bell | 206/391 |

(Continued)

OTHER PUBLICATIONS

Thermo Scientific, Thermo Scientific Upright Air Cooled Blast Freezer Specifications, Document No. DSBLSTFZ (Jun. 2010) (2 pages).

(Continued)

*Primary Examiner* — Janet M Wilkens
(74) *Attorney, Agent, or Firm* — Wood, Herron & Evans, LLP

(57) ABSTRACT

A storage basket is configured to hold multiple product units such as blood bags within the cabinet of a freezer. The storage basket includes first and second spaced-apart sidewalls and a plurality of inclined shelves extending between and coupled to these sidewalls. The inclined shelves include a plurality of air flow apertures that defined storage receptacles for product units as well as additional flow apertures to ensure minimal hindrance of cooling air flow within the freezer. The storage basket also includes handles that enable easy grasping and movement of multiple product units at once into and out of the freezer. As a result, the amount of time needed to cool product units down to a desired temperature with the freezer is reduced and the storage density within the freezer is increased.

20 Claims, 12 Drawing Sheets

(56) References Cited

U.S. PATENT DOCUMENTS

| | | | | | |
|---|---|---|---|---|---|
| 2,103,885 | A | | 12/1937 | Whalen | |
| 2,255,153 | A | | 9/1941 | Crowley | |
| 2,286,785 | A | | 6/1942 | Carlson | |
| 2,560,161 | A | * | 7/1951 | Fay et al. | 211/72 |
| 2,611,851 | A | * | 9/1952 | Lott | 219/387 |
| 2,654,115 | A | * | 10/1953 | Kafer | 16/421 |
| 2,789,700 | A | * | 4/1957 | King et al. | 108/32 |
| 2,944,696 | A | * | 7/1960 | Effgen | 220/507 |
| 3,102,640 | A | * | 9/1963 | Keller | 211/128.1 |
| 3,685,687 | A | * | 8/1972 | Eckdahl | 206/504 |
| 3,703,326 | A | * | 11/1972 | Riviers | 312/348.3 |
| 3,834,778 | A | | 9/1974 | Morrison et al. | |
| 3,875,754 | A | * | 4/1975 | Faust et al. | 62/60 |
| 4,079,873 | A | * | 3/1978 | De La Mora | 294/142 |
| 4,304,354 | A | * | 12/1981 | Shermer | 229/120.23 |
| 4,531,646 | A | | 7/1985 | Howard | |
| 4,718,545 | A | | 1/1988 | Chrzanowski et al. | |
| 4,765,494 | A | * | 8/1988 | Avery | 211/69.5 |
| 4,796,761 | A | * | 1/1989 | Hermelin | 211/11 |
| 4,832,208 | A | * | 5/1989 | Finnegan | 211/73 |
| 5,050,748 | A | * | 9/1991 | Taub | 211/59.2 |
| 5,303,997 | A | | 4/1994 | Kropf | |
| 5,743,399 | A | | 4/1998 | Beckwith | |
| 5,842,179 | A | | 11/1998 | Beavers et al. | |
| 5,938,048 | A | * | 8/1999 | Carroll et al. | 211/55 |
| 6,129,219 | A | * | 10/2000 | Peickert | 211/74 |
| 6,186,345 | B1 | * | 2/2001 | Robertson | 211/59.2 |
| 6,220,682 | B1 | | 4/2001 | Vertullo | |
| 6,663,204 | B2 | | 12/2003 | Atalla et al. | |
| 6,684,646 | B2 | | 2/2004 | Voute et al. | |
| 6,766,652 | B2 | | 7/2004 | Kelly et al. | |
| 6,799,689 | B2 | | 10/2004 | Langtry | |
| 6,923,519 | B2 | | 8/2005 | Dallman et al. | |
| D516,914 | S | * | 3/2006 | Ducharme et al. | D9/456 |
| 7,264,322 | B2 | | 9/2007 | Dallman et al. | |
| 7,325,697 | B2 | | 2/2008 | Lim et al. | |
| D593,810 | S | * | 6/2009 | Goodman et al. | D7/600.4 |
| 7,604,930 | B1 | | 10/2009 | Gao et al. | |
| 7,617,690 | B2 | | 11/2009 | Dawes | |
| 7,709,241 | B2 | | 5/2010 | Glaser et al. | |
| 7,733,666 | B2 | | 6/2010 | Ichihara et al. | |
| 7,766,437 | B2 | | 8/2010 | Lim et al. | |
| 7,861,540 | B2 | | 1/2011 | Cloutier et al. | |
| 7,870,748 | B2 | | 1/2011 | Byrne | |
| 8,025,155 | B2 | | 9/2011 | Pippin | |
| 8,037,833 | B2 | * | 10/2011 | Hardy | 108/91 |
| 8,176,747 | B2 | | 5/2012 | Howard et al. | |
| 8,292,095 | B2 | | 10/2012 | Howlett | |
| 8,424,693 | B1 | | 4/2013 | Hoover | |
| 2002/0024273 | A1 | * | 2/2002 | Osawa | 312/128 |
| 2004/0084390 | A1 | * | 5/2004 | Bernstein | 211/59.2 |
| 2006/0290249 | A1 | * | 12/2006 | Chang | 312/351 |
| 2008/0016886 | A1 | | 1/2008 | Slate et al. | |
| 2008/0164229 | A1 | | 7/2008 | Richter et al. | |
| 2009/0308770 | A1 | | 12/2009 | Wilcox | |
| 2012/0024006 | A1 | * | 2/2012 | Knoll et al. | 62/465 |
| 2012/0146480 | A1 | | 6/2012 | Yochum et al. | |
| 2012/0305570 | A1 | | 12/2012 | Aprea et al. | |

OTHER PUBLICATIONS

Thermo Scientific, Revco Ultra-Low Termparture Freezers, Your Samples, Our Obsession, Brochure BRCSREVCOULT-VWS1111, (Nov. 2011) (32 pages).

* cited by examiner

REMOVABLE STORAGE BASKET AND ASSOCIATED METHODS FOR STORING ITEMS WITHIN A FREEZER

TECHNICAL FIELD

The present invention relates generally to apparatus and methods for refrigeration and storage of a plurality of products such as samples of bodily fluids, and more specifically, to storage baskets used to hold the plurality of products and their method of use within a refrigeration device.

BACKGROUND

Cold storage units such as freezers are used for various purposes, including the storage of biological samples over short and long periods of time. For example, biological materials for transplantation such as blood, tissue, or plasma may require storage for short periods of time before use. In another example, biological cells such as DNA samples may be stored for longer periods of time. Conventional cold storage units may be cooled by mechanical refrigeration circuits or by other methods, including the provision of liquid nitrogen ("LN2"). One type of cold storage unit used to store biological samples is known as an "ultra-low temperature freezer" ("ULT"), which is used to cool its inner storage chamber to relatively low temperatures such as about −80° C. or lower, for example.

In order to avoid degradation of the biological materials or DNA samples, it is desirable to rapidly lower the temperature of these items after initial placement in the freezer. As a result, some conventional freezers and ULTs include a cabinet configured to receive a high speed cooling air flow driven through an evaporator of a refrigeration circuit or another known cooling heat exchanger. This high speed cooling air flow must quickly flow throughout the entire cabinet in order to effectively provide cooling energy at all positions in the cabinet. Thus, any supporting shelves located within the cabinet are typically formed with flow apertures or manufactured from a grid-like structure defining flow apertures to enable the cooling air flow to move through the supporting shelves. Moreover, conventional freezers may include an outer door and a plurality of inner doors that may be opened after the outer door to provide limited access to just one of the supporting shelves. The use of outer and inner doors also assists with the rapid cooling of the biological materials or DNA samples after a door opening because the amount of cold air lost through the door opening is limited by the smaller size of the door being opened.

In these conventional freezers and ULTs, it is typical for operators to individually place blood bags or other similar items directly onto the supporting shelves in the cabinet. However, this individual placement of blood bags into and out of the freezer reduces the cooling speed and efficiency of the freezer. To this end, an operator may not know the exact location on a supporting shelf where a desired blood bag is stored, so the operator may need to leave the door of the freezer open for extended periods of time, or reopen the doors multiple times to find a single blood bag while multiple bags are checked to find the desired blood bag. Such extended door openings or multiple door openings allow a significant portion of the cold air to leave the freezer, thereby undermining the inclusion of the outer and inner doors.

Furthermore, operators also may affect the cooling efficiency within the cabinet by placing blood bags or similar items directly onto the supporting shelves within the cabinet. For example, operators may position blood bags in relatively close proximity on the supporting shelves to achieve a higher storage density of blood bags. However, the blood bags may then cover a substantial portion or all of the flow apertures formed in the supporting shelves, which inhibits the rapid cooling air flow from movement throughout the cabinet. Consequently, blood bags or other items stored at a bottom of the cabinet (e.g., when the cooling heat exchanger or evaporator is on the top of the cabinet) may not receive rapid cooling energy as quickly as desired. When only one or a limited number of freezers are available to operators, this overloading of the supporting shelves to achieve a higher storage density proves to be difficult to avoid, even though such overloading reduces the operational cooling efficiency of the freezer.

There is a need, therefore, for a storage basket and methods that further simplify the retrieval and storage process for a plurality of storage bags or other products inside a freezer, thereby reducing the time that the freezer has to be opened and increasing the cooling efficiency of the system.

SUMMARY OF THE INVENTION

The present invention overcomes the foregoing and other shortcomings and drawbacks of solar mounting systems heretofore known. While the invention will be described in connection with certain embodiments, it will be understood that the invention is not limited to these embodiments. On the contrary, the invention includes all alternatives, modifications and equivalents as may be included within the spirit and scope of the present invention.

To this end, the present invention provides a storage basket configured to hold multiple product units such as blood bags inside a freezer. More specifically, the storage basket may be used with a freezer including a cabinet communicating with a cooling air flow and having a plurality of supporting shelves configured to enable the cooling air flow to move within and throughout the cabinet. The storage basket includes first and second spaced-apart sidewalls and a plurality of inclined shelves extending between and operatively coupled to the first and second sidewalls. The inclined shelves support the multiple product units thereon and are oriented at an acute (non-zero) angle relative to the horizontal plane, thereby increasing the storage density available on the supporting shelves. The storage basket also includes at least one handle for permitting manual grasping of the storage basket when an operator moves the storage basket into or from the freezer. The inclined shelves also include a plurality of air flow apertures configured to enable the cooling air flow in the cabinet to move around and through the storage basket and around the multiple product units.

Consequently, the storage basket helps increase the storage density available within the cabinet while improving the cooling efficiency. This improvement in cooling efficiency is enabled by providing apertures for the cooling air flow through the storage basket and the functionality of removing a plurality of multiple product units simultaneously from a freezer. In this regard, operators do not have to individually pick up and review multiple product units, while the freezer door(s) stands open, when the exact location of a product unit to be retrieved from the freezer is not known to the operator.

In one embodiment, the storage basket includes first and second handles positioned proximate to the first and second sidewalls. To this end, the first and second handles extend upwardly from the respective first and second sidewalls and also extend inwardly from the respective first and second sidewalls so as to overlie at least one of the plurality of inclined shelves. Accordingly, the first and second sidewalls of the storage basket may be positioned in close or abutting relation with the sidewalls of the cabinet or with adjacent storage baskets, if multiple storage baskets are used on each supporting shelf of the freezer. To this end, the handles are provided in a convenient place for access by an operator, while not limiting the storage density achieved by use of the storage basket in the freezer.

Each of the plurality of inclined shelves on the storage basket may further include an inclined shelf surface having front and rear edges, a front wall extending upwardly from adjacent the front edge, and a rear wall extending downwardly from adjacent the rear edge. The inclined shelf surface is configured to support the multiple product units thereon, and the front wall is positioned to prevent the multiple product units from sliding off the inclined shelf surface. The front and rear walls of the plurality of inclined shelves may also include positioning tabs projecting outwardly so as to be inserted into positioning slots in the first and second sidewalls of the storage basket. When the sidewalls and the plurality of inclined shelves are formed by punching sheets of metal material, the positioning tabs may be fastened (such as by spot welding) into position at the positioning slots of the first and second sidewalls to thereby permanently fix the plurality of inclined shelves with the first and second sidewalls. Additionally, the plurality of inclined shelves may include first and second inclined shelves, where the rear wall of the first inclined shelf is in abutting contact with the front wall of the second inclined shelf. In a further aspect, the rear wall of the first inclined shelf may ride over the front wall of the second inclined shelf so as to be located rearward of that front wall of the second inclined shelf. Consequently, the plurality of shelves can effectively hook or latch onto each other with the adjacent front and rear walls, thereby adding to the structural strength and rigidity of the storage basket.

In another aspect, the plurality of air flow apertures includes a first plurality of air flow apertures and a second plurality of air flow apertures defining a shape or size that is different than the shape or size of the first plurality of air flow apertures. The different shape or size of the first plurality of flow apertures provides an indication of receptacle locations that are configured to receive an individual unit of the multiple product units. In other words, an operator should be able to readily identify where to position blood bags or other product units based on the different shape or size of the first plurality of air flow apertures. Advantageously, each of these receptacle locations may be separated from other receptacle locations by one or more of the second plurality of air flow apertures, as this positioning of apertures ensures that the cooling air flow in the cabinet passes between each of the multiple product units positioned on the storage basket.

In the embodiments where bags containing fluid samples are stored in the freezer using the storage basket, the first plurality of air flow apertures are shaped to receive a projecting or bulging portion of the bags when the bags are laid into position on the inclined shelves. When fluid inside the bags freezes, the projecting portion in the shape of the first plurality of air flow apertures becomes visible on the bags when an operator flips the bags over. This frozen projecting portion provides a ready visual confirmation that the fluid inside the bags is frozen.

The storage basket may be resized to fit the preferences of the end operator of the freezer. More specifically, in one embodiment, a storage basket may be sized to completely fill one of the supporting shelves in the cabinet. To this end, the plurality of inclined shelves may be dimensioned with a width substantially equal to a total cabinet width defined by the supporting shelves in the cabinet of the freezer. In an alternative embodiment, more than one storage basket may be configured to be placed side-by-side to fill the supporting shelves in the cabinet. In these embodiments, the plurality of inclined shelves is dimensioned with a width smaller than the total cabinet width. For example, the first embodiment described above of the storage basket may hold up to 12 bags of fluid samples, while the alternative embodiment of the storage baskets may hold up to 6 bags of fluid samples apiece. Again, the particular size of storage baskets and grouping of multiple product units on the storage baskets may be suited in other embodiments for different preferences of the end operator.

As noted above, each of the plurality of inclined shelves may include first and second inclined shelves that each includes an inclined shelf surface with front and rear edges and a front wall. Instead of providing a rear wall on the first inclined shelf and hooking that rear wall into engagement with the front wall of the second inclined shelf (which positions the first inclined shelf entirely in front of the second inclined shelf), the first and second inclined shelves may be at least partially nested to increase the length of storage space available on each of the inclined shelf surfaces. To this end, the front edge and front wall of the second inclined shelf would be positioned underneath the inclined shelf surface of the first inclined shelf and also forward from the rear edge of the first inclined shelf. That positioning enables a portion of the multiple product units stored on the second inclined shelf to be located directly underneath at least a portion of the multiple product units stored on the first inclined shelf. The particular angling and amount of nesting of the inclined shelves may be further modified according to the needs of the end operator of the freezer and storage basket.

In another embodiment, a storage basket may be used with a freezer including a cabinet communicating with a cooling air flow and having a plurality of supporting shelves configured to enable the cooling air flow to move within and throughout the cabinet. The storage basket includes first and second spaced-apart sidewalls and a plurality of inclined shelves extending between and operatively coupled to the first and second sidewalls. The inclined shelves support the multiple product units thereon and are oriented at an acute (non-zero) angle relative to the horizontal plane, thereby increasing the storage density available on the supporting shelves. The inclined shelves also include a plurality of air flow apertures configured to enable the cooling air flow in the cabinet to move around and through the storage basket and around the multiple product units. The plurality of air flow apertures includes a first plurality of air flow apertures and a second plurality of air flow apertures defining a shape or size that is different than the shape or size of the first plurality of air flow apertures. The different shape or size of the first plurality of flow apertures provides an indication of receptacle locations that are configured to receive an individual unit of the multiple product units. In other words, an operator should be able to readily identify where to position blood bags or other product units based on the different shape or size of the first plurality of air flow apertures. Advantageously, each of these receptacle locations may be separated from other receptacle locations by one or more of the second plurality of air flow apertures, as this positioning of apertures ensures that the cooling air flow in the cabinet passes between each of the multiple product units positioned on the storage basket.

According to another embodiment of the present invention, a method of storing multiple product units inside a freezer is provided. As described above, the freezer includes a cabinet communicating with a cooling air flow and has a plurality of supporting shelves configured to enable the cooling air flow to move within the cabinet. The method includes positioning multiple product units onto a plurality of inclined shelves of a storage basket and moving the storage basket using first and second handles into the cabinet of the freezer. The storage basket is placed onto one of the plurality of supporting shelves such that all of the multiple product units are simultaneously inserted into the freezer. The plurality of inclined shelves of the storage basket is oriented at an acute angle relative to a horizontal plane and this increases the storage density available on the supporting shelf. A door of the cabinet is then closed after the storage basket is placed in the cabinet, thereby enabling the cooling air flow to rapidly cool the multiple product units by flowing through the supporting shelves and the plurality of inclined shelves. Accordingly, more product units may be simultaneously inserted and/or removed from the freezer and rapid and efficient cooling of the cabinet is achieved.

When a preselected one of the multiple product units stored on the storage basket is to be retrieved from the freezer, the method also includes opening the door of the cabinet and moving the storage basket using the first and second handles out of the cabinet. The door of the cabinet may then be re-closed so that the cooling air flow continues to chill the cabinet while the preselected one of the multiple product units is identified and removed from the storage basket. The multiple product units may include bags containing fluid samples, and these bags are positioned onto a first plurality of air flow apertures such that top and bottom sides of the bags are exposed to the cooling air flow. In addition, a projecting portion of the bag that seats into the first air flow apertures will remain visible if the fluid inside the bag is frozen when the bags are flipped over following removal of the storage basket from the freezer. This visual indication may be provided quickly by just flipping over the bags on the storage basket. It will be understood that the storage basket also includes a second plurality of air flow apertures that are left uncovered by the multiple product units so as to enable the cooling air flow to freely flow through the storage basket and around the multiple product units.

The method may also include assembling the storage basket from first and second sidewalls and the plurality of inclined shelves. This assembly includes aligning positioning tabs projecting from front and rear walls of the plurality of inclined shelves with positioning slots formed in the first and second sidewalls. The positioning tabs may then be inserted through the positioning slots. The assembly also includes fixing the positioning tabs to the first and second sidewalls at the positioning slots to couple the plurality of inclined shelves into position so as to extend between the first and second sidewalls. The assembly is then ready for use as the storage basket.

These and other objects and advantages of the present invention will become more readily apparent during the following detailed description taken in conjunction with the drawings herein.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
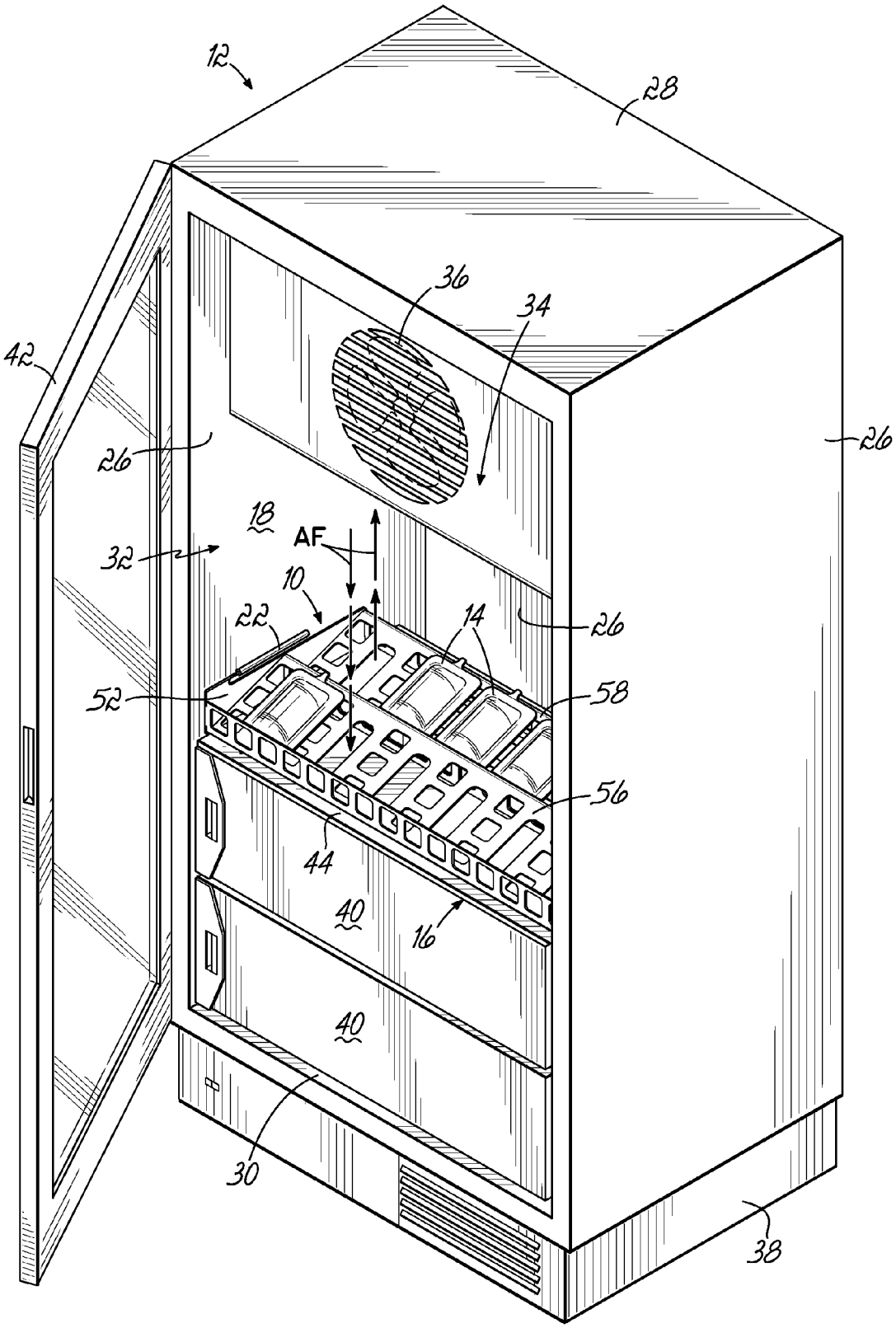
FIG. 1 is a perspective view of a storage basket according to one embodiment positioned on a supporting shelf within a cabinet of a freezer, the storage basket being loaded with multiple product units.

FIGS. 1 through 12 illustrate a first embodiment of a storage basket 10 used with a freezer 12 according to the present invention, to store and cool multiple product units 14 to very low temperatures. The storage basket 10 is configured to hold multiple individual product units 14, which are shown in the exemplary embodiment to be bags for containing bodily fluid samples such as plasma or blood (hereinafter referred to as "product units 14" and/or "blood bags 14"). The storage basket 10 is also optimized to increase the storage density of product units 14 on supporting shelves 16 within the freezer 12, and to encourage a cooling air flow (indicated schematically in FIGS. 1 and 2 with arrow AF) within the freezer 12 to flow through the storage basket 10 and around the blood bags 14. Therefore, the cooling efficiency of the freezer 12 in operation is improved by enabling the simultaneous removal of multiple blood bags 14 with a single quick operation (thereby avoiding longer periods of the freezer 12 being open to the ambient environment) and also by ensuring sufficient cooling air flow movement within and throughout essentially the entire freezer 12. It will be understood that other types of multiple product units 14 may be stored on the storage basket 10 in other embodiments, and the storage basket 10 may also be used with other cooling devices or storage units, such as a refrigerator, without departing from the scope of the present invention.

Figure 2:
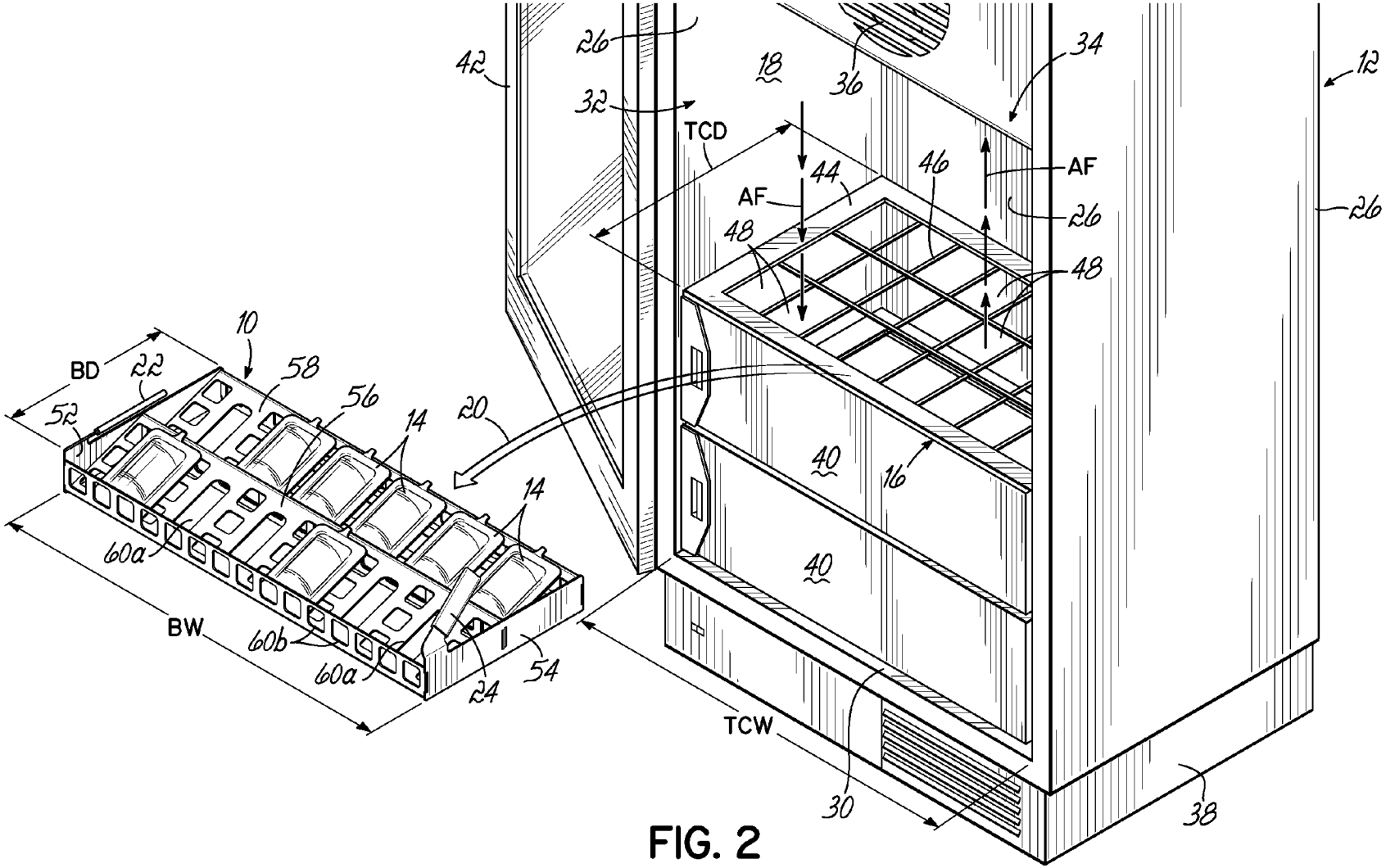
FIG. 2 is a perspective view of the storage basket of FIG. 1 during removal from the cabinet of the freezer, thereby illustrating further features of the storage basket and the supporting shelf within the freezer.

With particular reference to FIGS. 1 and 2, the storage basket 10 of this embodiment is shown in use with the freezer 12. To this end, the storage basket 10 is shown in position within a cabinet 18 of the freezer 12 in FIG. 1, and the storage basket 10 is shown during removal from the cabinet 18 in FIG. 2. Although the storage basket 10 is shown only partially loaded with seven of the blood bags 14 in these Figures, it will be understood that the storage basket 10 may be filled to any extent during use, including being filled to a maximum capacity of twelve blood bags 14. Of course, the maximum capacity of this embodiment is provided for exemplary purposes only, as the capacity may be modified as described in connection with alternative embodiments below and also in other embodiments. The storage basket 10 of this embodiment is sized to fit on one of the supporting shelves 16 located within the cabinet 18 of the freezer 12. Furthermore, the removal (and insertion) of the storage basket 10 as shown along arrow 20 in FIG. 2 is easily performed by an operator grasping the two handles 22, 24 provided on the storage basket 10. As shown in FIG. 1, these handles 22, 24 are conveniently positioned for access by the operator both when the storage basket 10 is inside the freezer 12 and also when the storage basket 10 is outside the freezer 12.

The freezer 12 shown in these Figures may include a blood blast freezer 12 in the form of an ultra-low temperature (ULT) freezer 12 that is capable of cooling the cabinet 18 to temperatures of −80° C., or lower. This freezer 12 is commercially available, for example, from Thermo Fisher Scientific, of Asheville, N.C., as the products entitled Revco® UxF Series Freezers and Revco® ExF Upright Freezers. As shown in FIGS. 1 and 2, the freezer 12 includes a plurality of insulated sidewalls 26 extending between a top wall 28 and a bottom wall 30 to define the cabinet 18. The cabinet 18 includes a front opening 32 along the front that is configured to be closed by a plurality of doors, as described below. The freezer 12 also includes a refrigeration system including a cooling heat exchanger 34 in the form of an evaporator located adjacent the top wall 28 of the cabinet 18. An evaporator fan 36 at the cooling heat exchanger 34 forces rapid cooling air flow (as shown by arrow AF) within the cabinet 18, which then returns back into the cooling heat exchanger 34 for heat energy removal. The remainder of the components of the refrigeration system (e.g., compressor, condenser, etc.) are contained within a deck 38 located below the bottom wall 30 of the cabinet 18. It will be understood that the cooling heat exchanger 34 may be repositioned within the cabinet 18 (or even outside the cabinet 18 with ducts leading to the cabinet 18) in other embodiments, and one or more of the other components of the refrigeration system may also be located in other positions outside the deck 38 without departing from the scope of the present invention. Moreover, other types of refrigeration systems and cooling heat exchangers (for example, liquid nitrogen banks, cooling plates, and other cooling methods) may be used as well, as the storage basket 10 is configured for use with many different types of freezers and cooling devices. However, the storage basket 10 and supporting shelves 16 advantageously enable the freezer 12 to provide sufficient cooling energy within the cabinet 18 without necessitating the use of these other types of cooling equipment and methods.

As mentioned above, the cabinet 18 includes a plurality of supporting shelves 16 that subdivide a storage space within the cabinet 18 into multiple storage compartments. In the illustrated example, there are three supporting shelves 16 for three storage compartments. Each of the storage compartments may be closed individually along the front opening 32 by an inner door 40. Although only the bottom two inner doors 40 are illustrated in FIGS. 1 and 2 so that the uppermost supporting shelf 16 and the cooling heat exchanger 34 are visible, it will be understood that additional inner doors 40 may be stacked along the height of the cabinet 18 at the front opening 32. For example, there may be four or five total inner doors 40, with the lowermost three of these inner doors 40 providing access selectively into one of the storage compartments with a supporting shelf 16. The freezer 12 also includes an outer door 42 which is shown pivoted to an open position in FIGS. 1 and 2. The outer door 42 covers the entire front opening 32 and is configured to be opened to provide access to any of the inner doors 40 and the corresponding storage compartments. The provision of inner doors 40 and an outer door 42 allows for two levels of sealing protection between the cabinet 18 and the ambient environment, and also advantageously enables an operator to limit the size of the opening into the cabinet 18 when a specific storage basket 10 is to be retrieved or inserted into the freezer 12. This door feature, when combined with the ability to remove an entire storage basket 10 filled with blood bags 14 at once, tends to decrease any temperature spikes in the cabinet 18 caused by door openings and therefore increases the overall cooling efficiency of the freezer 12. Accordingly, it will be understood that the storage basket 10 must be designed to easily fit through and be conveniently accessed through the smaller opening spaces allowed by the inner doors 40 to achieve this additional efficiency.

Each of the supporting shelves 16 in this embodiment is formed as a stationary perforated shelf formed from stainless steel or a similar structural material. To this end, the supporting shelf 16 that is visible in FIG. 2 includes a peripheral rim 44 coupled to the insulated sidewalls 26 and a grid-work 46 or lattice of stainless steel wires defining a plurality of shelf apertures 48 configured to enable the cooling air flow AF to move between the various storage compartments in the cabinet 18. It will be appreciated that other forms of apertures in a supporting shelf 16 may be provided without departing from the scope of the present invention. As can be readily understood from FIG. 2, the shelf apertures 48 are designed to fill a substantial portion of the area of the supporting shelf 16 so that the supporting shelf 16 avoids inhibiting the rapid cooling air flow AF from movement to the cooling heat exchanger 34 and throughout essentially the entire cabinet 18. In this regard, the high volume or area of opening between the storage compartments ensures that even a lowermost storage compartment receives the cooling air flow AF from the cooling heat exchanger 34 located at the top of the cabinet 18. Furthermore, the formation of the supporting shelf 16 from a rigid structural material such as stainless steel enables the shelf apertures 48 to be as large as possible while still providing adequate and reliable support for a fully loaded storage basket 10. As described in further detail below, the large size and number of shelf apertures 48 in each supporting shelf 16 cooperates with a plurality of air flow apertures in the storage basket 10 to avoid blocking the cooling air flow AF from circulating within the entire cabinet 18 for a maximized cooling efficiency.

Figure 3:
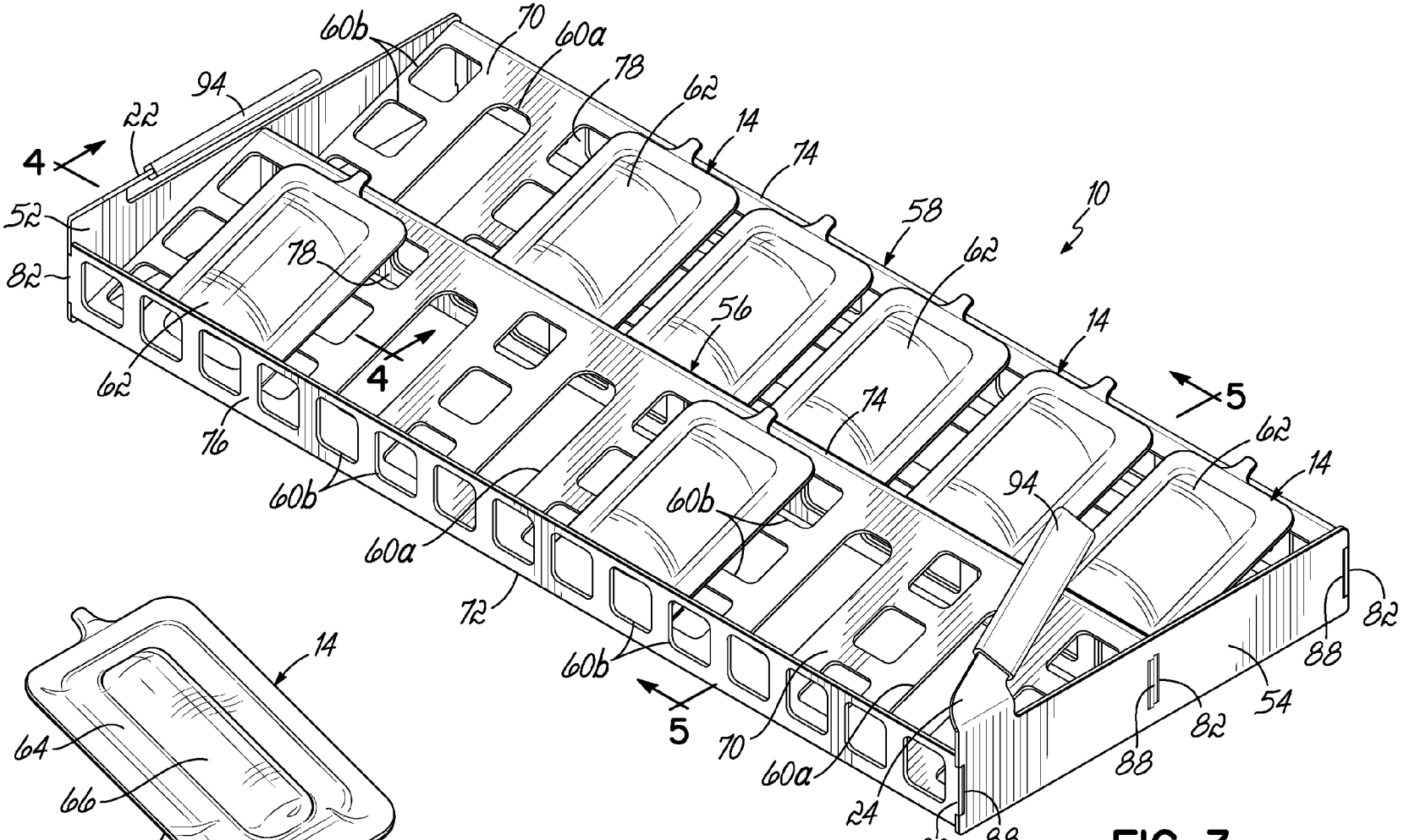
FIG. 3 is a perspective view of the storage basket of FIG. 1 removed from the freezer.
Figure 4A:
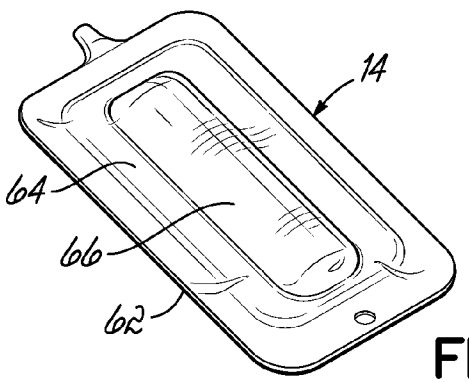
FIG. 4A is a perspective view of the product unit shown in FIG. 4, flipped over to reveal a visual indication of whether fluid in the product unit is frozen.
Figure 4:
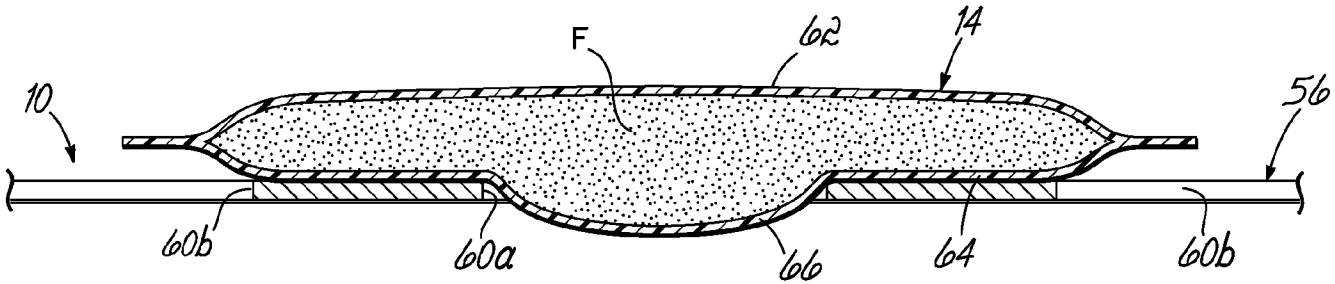
FIG. 4 is a partial cross sectional front view, taken along line 4-4, through one of the multiple product units and an inclined shelf of the storage basket of FIG. 3.
Figure 5:
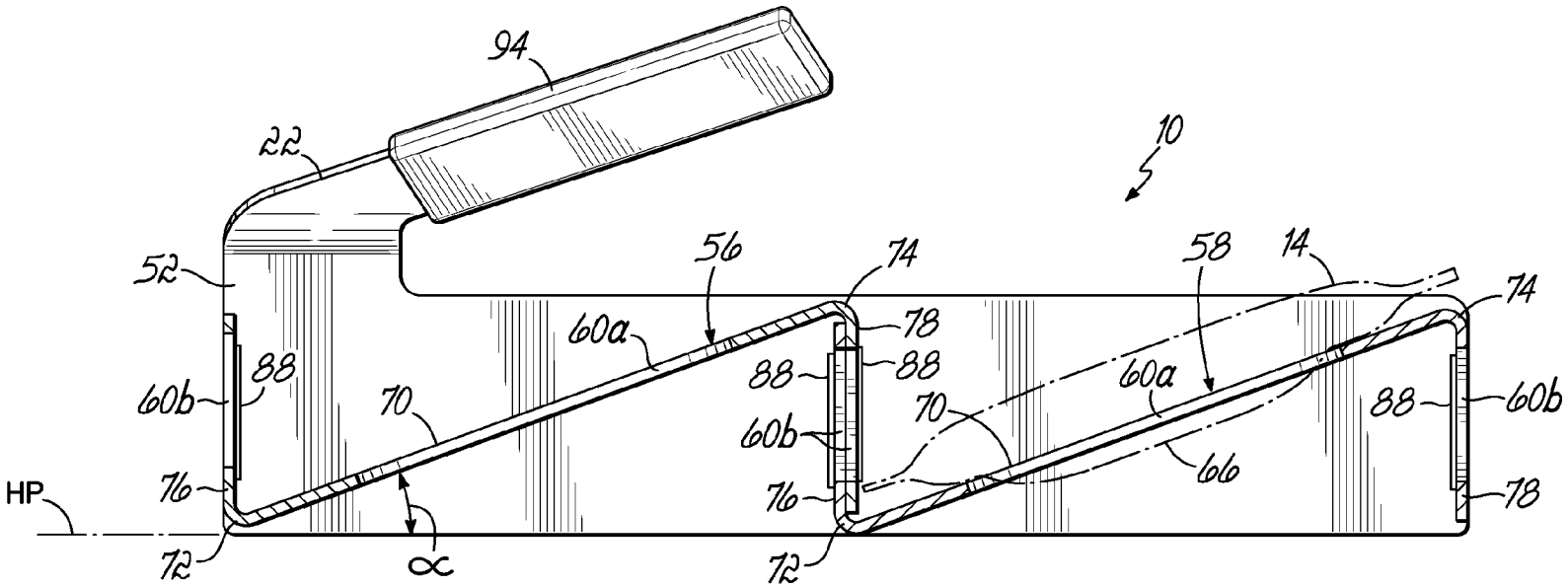
FIG. 5 is a cross sectional side view, taken along line 5-5, through the inclined shelves of the storage basket of FIG. 3.

With reference to FIGS. 3 through 5, the storage basket 10 loaded with several product units 14 (such as blood bags 14 configured to contain 325 mL to 600 mL of fluid) is shown in further detail apart from the freezer 12. To this end, FIG. 3 illustrates that the storage basket 10 further includes a first sidewall 52 and a second sidewall 54 spaced apart from each other with first and second inclined shelves 56, 58 extending between the sidewalls 52, 54. The handles 22, 24 are connected to and extend from the respective first and second sidewalls 52, 54 as shown, although it will be understood that the handles 22, 24 may alternatively be coupled to or extending from the inclined shelves 56, 58 in other embodiments. In the embodiment illustrated in these Figures, the first and second handles 22, 24 are formed as a unitary portion of the first and second sidewalls 52, 54, respectively, and this arrangement enables the storage basket 10 to be assembled quickly by aligning and fastening each of the inclined shelves 56, 58 with the sidewalls 52, 54 as described in further detail with reference to FIGS. 6 and 7 below.

In addition to the handles 22, 24, the sidewalls 52, 54, and the inclined shelves 56, 58, the storage basket 10 also includes a plurality of air flow apertures 60*a*, 60*b* shown in this embodiment as a first plurality of air flow apertures 60*a* and a second plurality of air flow apertures 60*b*. The first plurality of air flow apertures 60*a* define receptacles configured to receive and support blood bags 14 on the storage basket 10, while the second plurality of air flow apertures 60*b* provide openings and flow paths for the cooling air flow in the freezer 12 to move freely around the blood bags 14 and through the storage basket 10 to other portions of the cabinet 18. In this regard, the first plurality of air flow apertures 60*a* indicate where blood bags 14 should be positioned on the storage basket 10. It will be understood that the first plurality of air flow apertures 60*a* also provides openings and flow paths for the cooling air flow in positions where blood bags 14 are not located during a partial loading of the storage basket 10 with fewer than the maximum capacity, such as the seven blood bags 14 shown in FIG. 3. However, the second plurality of air flow apertures 60*b* provide sufficient open space to avoid inhibiting the cooling air flow from movement throughout the cabinet 18 even when the storage basket 10 is completely loaded with a maximum capacity of blood bags 14, which would be twelve such bags in the illustrated embodiment.

The first plurality of air flow apertures 60*a* defines a different shape and size than the second plurality of air flow apertures 60*b* so as to encourage proper loading of the blood bags 14 onto the intended receptacles of the storage basket 10. For example, the first plurality of air flow apertures 60*a* defines openings with an elongate oval-shape or a rectangular-shape with rounded corners. These elongate shapes are immediately identified as distinctive from the smaller, generally square-shaped (with rounded corners) openings defined by the second plurality of air flow apertures 60*b*. As a result, the storage basket 10 will likely not be overloaded by an operator and the air flow through the storage basket 10 and through the cabinet 18 will be maintained at desirable levels. Of course, the first and second pluralities of air flow apertures 60*a*, 60*b* may be reshaped and resized from the profiles shown in FIG. 3 to define different flow openings in other embodiments.

In the exemplary embodiment shown in these Figures, the elongate shape of the first plurality of air flow apertures 60*a* enables multiple advantages as evidenced more clearly from the cross-sectional view taken through one of the blood bags 14 on the first inclined shelf 56 in FIG. 4 and the view of the blood bag 14 in FIG. 4A. To this end, when the blood bag 14 is positioned at the corresponding air flow apertures 60*a* on the first inclined shelf 56, a top side 62 of the blood bag 14 faces away from the first inclined shelf 56 while a bottom side 64 of the blood bag 14 sits upon the first inclined shelf 56. In addition, the liquid state of fluid F within the blood bag 14 causes a projecting portion 66 to be formed along the bottom side 64, the projecting portion 66 extending or bulging at least partially through the air flow aperture 60*a*. To this end, the projecting portion 66 may be entitled a bulging portion as well. Consequently, the cooling air flow AF within the cabinet 18 can come into contact with the entire top side 62 of the blood bag 14 as well as a substantial portion of the bottom side 64 at the projecting portion 66. The cooling air flow AF therefore reduces the temperature of the fluid F within the blood bag 14 more rapidly than would otherwise be possible when access to only one side of the blood bag 14 is provided.

Another advantage of the first plurality of air flow apertures 60*a* does not become evident until the blood bag 14 has been cooled so that the fluid F inside the blood bag 14 is frozen. Once this solidification by freezing occurs, the projecting portion 66 of the blood bag 14 will remain visible or frozen in position even when the blood bag 14 is removed from the storage basket 10. Accordingly, as shown in FIG. 4A, the frozen projecting portion 66 is clearly visible on the bottom side 64 of the blood bag 14 after being flipped over by an operator, thereby to visually confirm the frozen state. If the fluid F inside the blood bag 14 has not yet reached a frozen state, then the projecting portion 66 will collapse when the blood bag 14 is flipped over, and will not be visible to an operator. In this regard, the state of the fluid F within any of the blood bags 14 may be immediately known to an operator simply by flipping the blood bags 14 over as shown in FIG. 4A. Even if the first plurality of air flow apertures 60*a* is reshaped or resized as described above in alternative embodiments, some identifiable pattern formed by one or more projecting portions 66 should become and remain visible when the fluid F is in the frozen state.

In addition, another advantage of providing the first and second pluralities of air flow apertures 60*a*, 60*b* is that the second plurality of air flow apertures 60*b* may be used to separate the first plurality of air flow apertures 60*a* and receptacle locations from one another. In this regard, the cooling air flow AF is ensured between each pair of product units 14 that is stored on the storage basket 10. As a result, cooling air flow AF passes around all sides of each product unit 14 while flowing throughout the entirety of the cabinet 18. In other non-illustrated embodiments, multiple rows of the second plurality of air flow apertures 60*b* or more may be positioned between adjacent ones of the first plurality of air flow apertures 60*a*.

The loaded storage basket 10 is also cross-sectioned in a perpendicular direction from the view shown in FIG. 4 in order to illustrate additional aspects of the storage basket 10 and the second plurality of air flow apertures 60*b*. As shown in FIGS. 3 and 5, each of the first and second inclined shelves 56, 58 are formed so as to be generally identical. To this end, the first and second inclined shelves 56, 58 each include an inclined shelf surface 70 having a front edge 72 and a rear edge 74, a front wall 76 extending upwardly from adjacent the front edge 72 of the inclined shelf surface 70, and a rear wall 78 extending downwardly from adjacent the rear edge 74 of the inclined shelf surface 70. The second plurality of air flow apertures 60*b* is provided in the inclined shelf surfaces 70, the front walls 76, and the rear walls 78 of the first and second inclined shelves 56, 58. As a result, the cooling air flow AF within the cabinet 18 is able to freely move through each of these surfaces and walls of the storage basket 10 so as to reach other parts of the cabinet 18. In any event, the front and rear walls 76, 78 of the first and second inclined shelves 56, 58 provide structural rigidity to the first and second inclined shelves 56, 58 as well as a mechanism for connecting the first and second inclined shelves 56, 58 to the first and second sidewalls 52, 54, as described in further detail below.

In the exemplary embodiment shown in these Figures (and specifically in FIG. 5), the first and second inclined shelves 56, 58 are positioned such that the rear wall 78 of the first inclined shelf 56 abuts and rides over the front wall 76 of the second inclined shelf 58. This arrangement of the first and second inclined shelves 56, 58 provides an interlocked series of shelves 56, 58 when the storage basket 10 is assembled by connecting the inclined shelves 56, 58 to the first and second sidewalls 52, 54. However, the abutting contact of the rear wall 78 of the first inclined shelf 56 and the front wall 76 of the second inclined shelf 58 does not inhibit the cooling air flow AF because the second plurality of air flow apertures 60*b* in these front and rear walls 76, 78 are generally aligned with one another. In other embodiments in accordance with the present invention, the first and second inclined shelves 56, 58 may be aligned differently such that the rear wall 78 of the first inclined shelf 56 abuts and is located in front of the front wall 76 of the second inclined shelf 58 (thereby not riding over the second inclined shelf 58). Other arrangements of the front and rear walls 76, 78 may also be used in other embodiments, such as the alternative embodiment described with reference to FIG. 15 below.

FIG. 5 also shows a horizontal plane HP relative to the storage basket 10 when the storage basket 10 is placed on one of the supporting shelves 16 within the freezer 12. Accordingly, the inclined shelf surfaces 70 are each inclined at an acute angle $\alpha$ from the horizontal plane HP. For example, this acute angle $\alpha$ in the exemplary embodiment may be about 20°. This angling of the inclined shelf surfaces 70 enables the storage density of product units 14 on the storage basket 10 to be increased for a given horizontal surface area of the supporting shelves 16 in the freezer 12, and the particular angle $\alpha$ may be modified in other embodiments consistent with the scope of the present invention. Regardless of the particular arrangement of the front and rear walls 76, 78 of the first and second inclined shelves 56, 58 and the particular acute angle $\alpha$ chosen for the inclined shelf surfaces 70, the front wall 76 of each inclined shelf 56, 58 is configured to prevent product units 14 from sliding off the front edge 72 of the inclined shelf surfaces 70. In the interlocked and riding over arrangement shown in FIG. 5, the rear wall 78 of some inclined shelves 56, 58 may also assist with this function.

Figure 6:
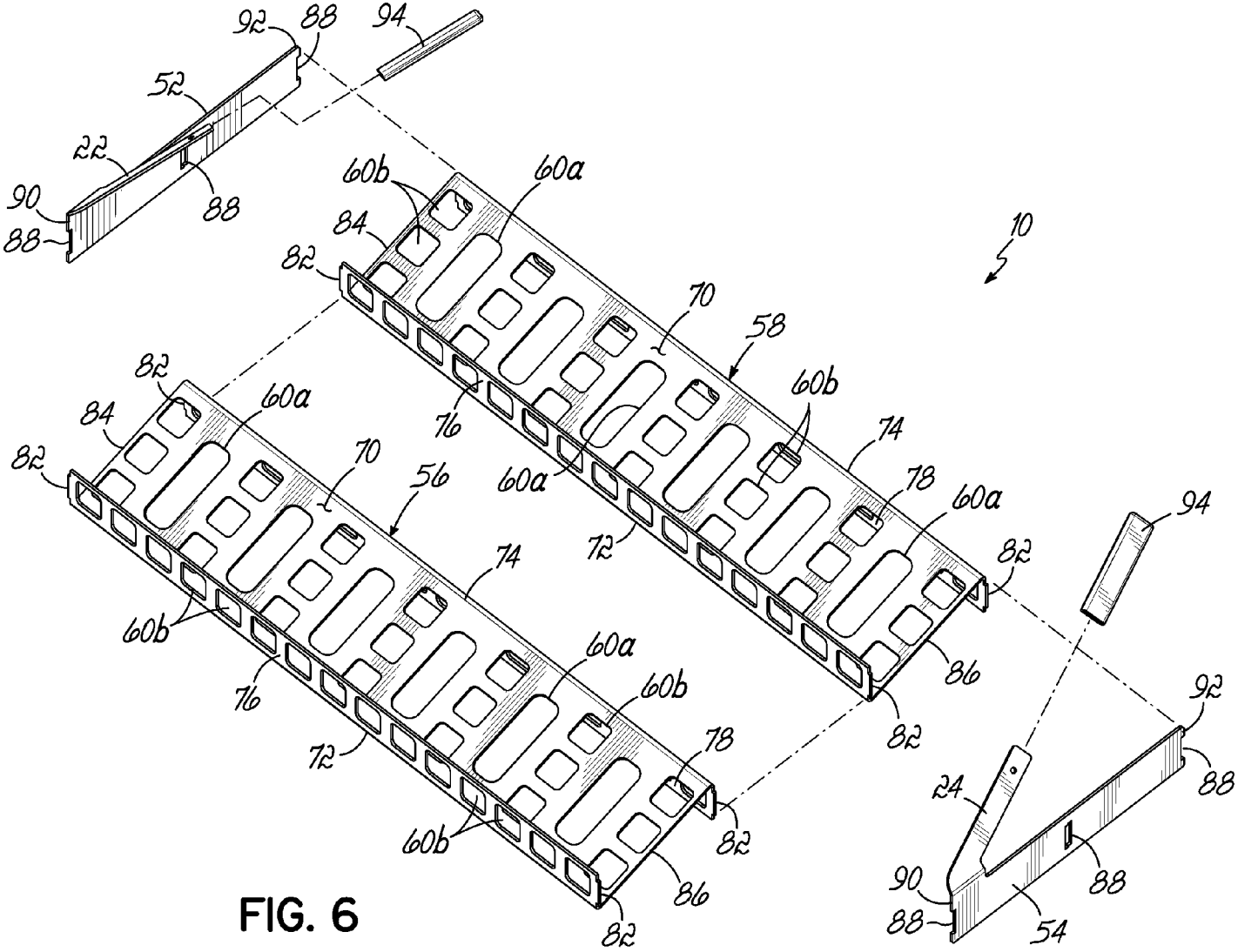
FIG. 6 is an exploded view of the storage basket of FIG. 3, thereby showing a plurality of constituent components assembled to make the storage basket.
Figure 7:
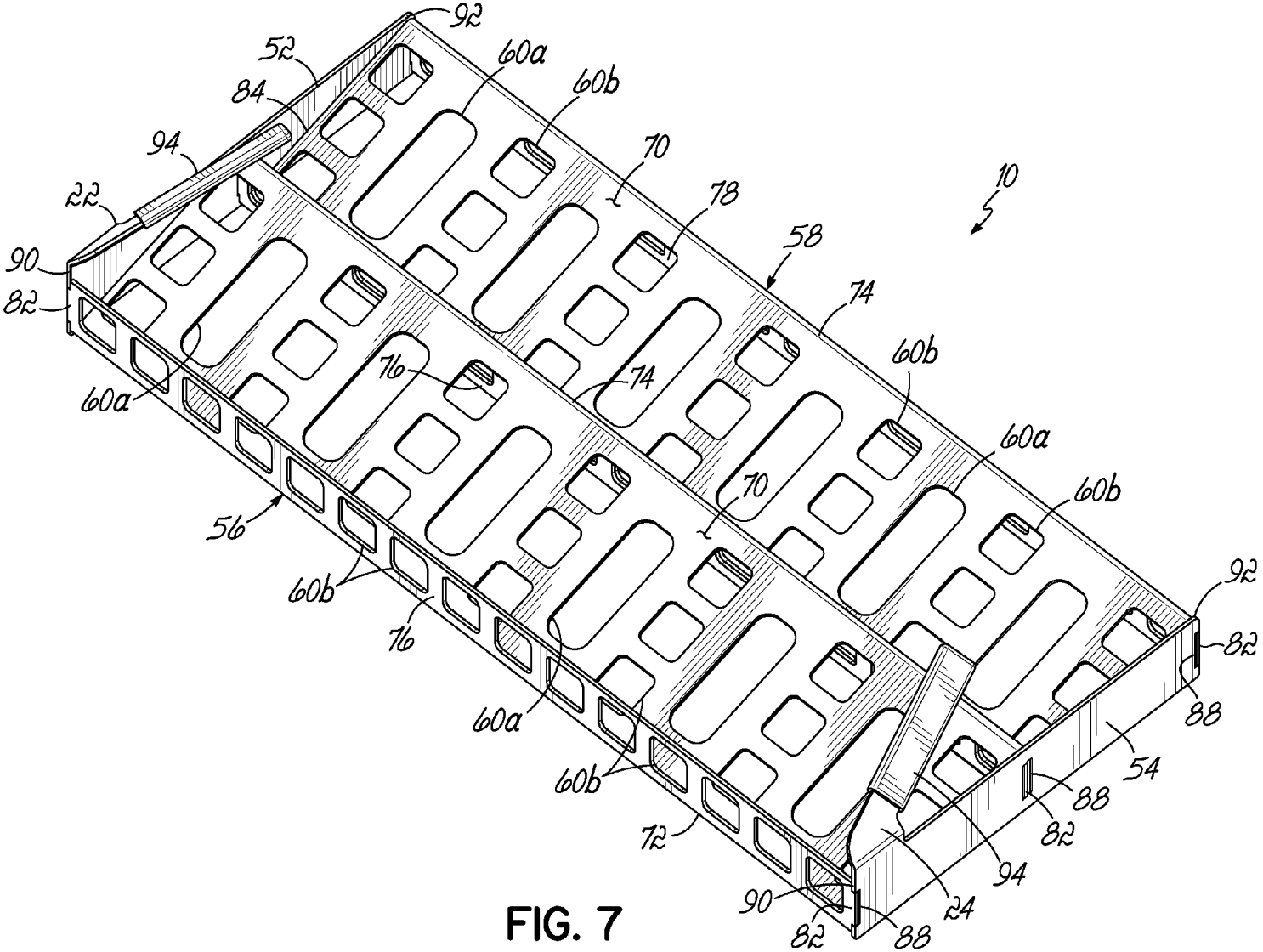
FIG. 7 is a perspective view of the storage basket of FIG. 3 without any of the multiple product units in position.

Turning to FIGS. 6 and 7, the storage basket 10 is illustrated exploded apart into constituent pieces and fully assembled without the product units 14 in position to show further aspects in accordance with the present invention. As shown most clearly in FIG. 6, each of the first and second sidewalls 52, 54 (which include the first and second handles 22, 24) and the first and second inclined shelves 56, 58 may be produced from a metallic sheet material such as aluminum, stainless steel, or carbon steel that has been punched to form the necessary flow apertures 60*a*, 60*b* and bent into the desired shape and orientation. It will be understood that each of these separate elements may also be formed from different types of material such as composite materials in other embodiments, and these alternative materials may be molded or manufactured from other methods beyond stamping and bending sheet materials. Once each of the separate elements shown in FIG. 6 have been generated, the first and second inclined shelves 56, 58 are aligned between the first and second sidewalls 52, 54 and then assembled together as described below.

To assist with the assembly and proper alignment of the elements exploded apart in FIG. 6, the front wall 76 and the rear wall 78 of each inclined shelf 56, 58 includes positioning tabs 82 projecting laterally outwardly from opposing lateral side edges 84, 86 of the inclined shelves 56, 58. To this end, each of the first and second inclined shelves 56, 58 includes two positioning tabs 82 extending towards the first sidewall 52 at the first lateral side edge 84 (one at the front wall 76, one at the rear wall 78), and two positioning tabs 82 extending towards the second sidewall 54 at the second lateral side edge 86. Each of the positioning tabs 82 is shown as having a rectangular shape in the exemplary embodiment, but the positioning tabs 82 may also be shaped differently in other embodiments because the positioning tabs 82 are formed along the lateral side edges 84, 86 of the inclined shelves 56, 58.

The positioning tabs 82 are shaped and sized to fit into corresponding positioning slots 88, which are located in the first and second sidewalls 52, 54. To this end, the positioning slots 88 are also shaped in the exemplary embodiment as rectangular slots configured to closely receive the corresponding positioning tabs 82 on the first and second inclined shelves 56, 58. More particularly, one positioning slot 88 is located at a front end 90 of each of the first and second sidewalls 52, 54 to receive the positioning tabs 82 projecting from the front wall 76 of the first inclined shelf 56. Another positioning slot 88 is located at a rear end 92 of each of the first and second sidewalls 52, 54 to receive the positioning tabs 82 projecting from the rear wall 78 of the second inclined shelf 58. Two more partially co-extensive positioning slots 88 are located in the middle of the first and second sidewalls 52, 54 and are configured to receive the positioning tabs 82 projecting from the rear wall 78 of the first inclined shelf 56 and the adjacent front wall 76 of the second inclined shelf 58. As shown in FIG. 6, the partially co-extensive positioning slots 88 in the center of the first and second sidewalls 52, 54 may be vertically offset a short distance from one another because when the rear wall 78 of the first inclined shelf 56 rides over the front wall 76 of the second inclined shelf 78, the rear wall 78 of the first inclined shelf 56 may sit atop the second inclined shelf 78 slightly higher in elevation than the front wall 76 of the second inclined shelf 78. It will be appreciated that the positioning tabs 82 and positioning slots 88 may be reoriented and repositioned in other embodiments without departing from the scope of the present invention.

Accordingly, the storage basket 10 is assembled as follows. The first and second sidewalls 52, 54 (including the handles 22, 24) and the first and second inclined shelves 56, 58 are manufactured, such as by the molding or punching and bending processes described above, and then positioned relative to one another generally as shown in FIG. 6. In embodiments where the rear wall 78 of the first inclined shelf 56 rides over the front wall 76 of the second inclined shelf 58, the first inclined shelf 56 is moved over the second inclined shelf 58 so that the rear wall 78 of the first inclined shelf 56 is in abutting contact with and located behind the front wall 76 of the second inclined shelf 58. The first and second sidewalls 52, 54 are then moved laterally into operative engagement with the first and second lateral side edges 84, 86 of the first and second inclined shelves 56, 58.

To this end, the positioning tabs 82 on the first and second lateral side edges 84, 86 are aligned with the positioning slots 88 located in each of the first and second sidewalls 52, 54. As the sidewalls 52, 54 are operatively coupled to the first and second inclined shelves 56, 58, the positioning tabs 82 are inserted through the positioning slots 88. In this regard, the first and second inclined shelves 56, 58 are accurately positioned and maintained in the correct position by the insertion of the positioning tabs 82 into the positioning slots 88. The positioning tabs 82 are then fixed to the first and second sidewalls 52, 54 at the positioning slots 88 to fix the first and second inclined shelves 56, 58 in position extending between the first and second sidewalls 52, 54. This fixing of the positioning tabs 82 may be conducted by any known method for fixing elements together, including welding, adhesive bonding, etc. Once the positioning tabs 82 are fixed in position in the positioning slots 88, the assembly of the primary components of the storage basket 10 is completed. Consequently, the manufacturing and assembly of the storage baskets 10 is straightforward and cost-efficient.

One additional assembly step may also be required, especially when the storage basket 10 is formed from a metallic material. Although operators of the freezer 12 typically wear protective gloves when handling items from the freezer 12, a handle cover 94 such as a rubberized grip handle cover 94 may be applied to each of the first and second handles 22, 24 to further isolate the operator from the cold storage basket 10. Moreover, the rubberized grip handle cover 94 improves the ability of an operator to reliably and quickly retrieve and place the storage basket 10 into and out of the cabinet 18 of the freezer 12. In embodiments with such handle covers 94, the assembly is completed by pushing those handle covers 94 onto the first and second handles 22, 24 so as to surround those handles 22, 24. It will be appreciated that the handle covers 94 may be formed from various different materials and in different lengths and shapes without departing from the scope of the present invention.

The final assembled version of the storage basket 10 according to this embodiment is shown in various views in FIGS. 7 through 12. Several additional features or details of the storage basket 10 are shown in these views. For example, the positioning of the first and second handles 22, 24 relative to the remainder of the storage basket 10 is more readily visible in FIGS. 8 and 9. To this end, each of the first and second handles 22, 24 extends upwardly from the corresponding first and second sidewalls 52, 54 while also extending inwardly from the corresponding first and second sidewalls 52, 54. Thus, the first and second handles 22, 24 at least partially overlie at least one of the inclined shelves 56, 58 extending between the first and second sidewalls 52, 54. This positioning of the handles 22, 24 enables easy manual grasping of the storage basket 10 even when the first and second sidewalls 52, 54 are located in close relation to insulated sidewalls 26 of the cabinet 18 when the storage basket 10 is placed within the freezer 12.

Figure 9:
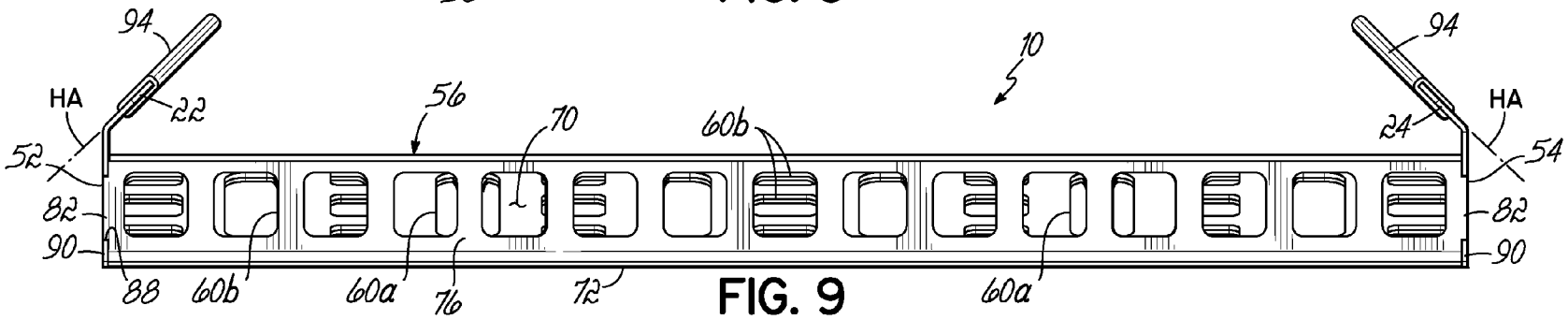
FIG. 9 is a front elevational view of the storage basket of FIG. 7.
Figure 10:
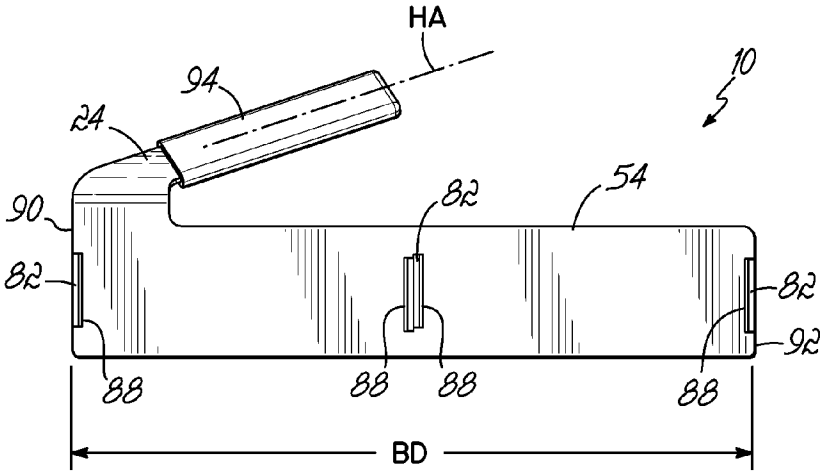
FIG. 10 is a right side view of the storage basket of FIG. 7.
Figure 11:
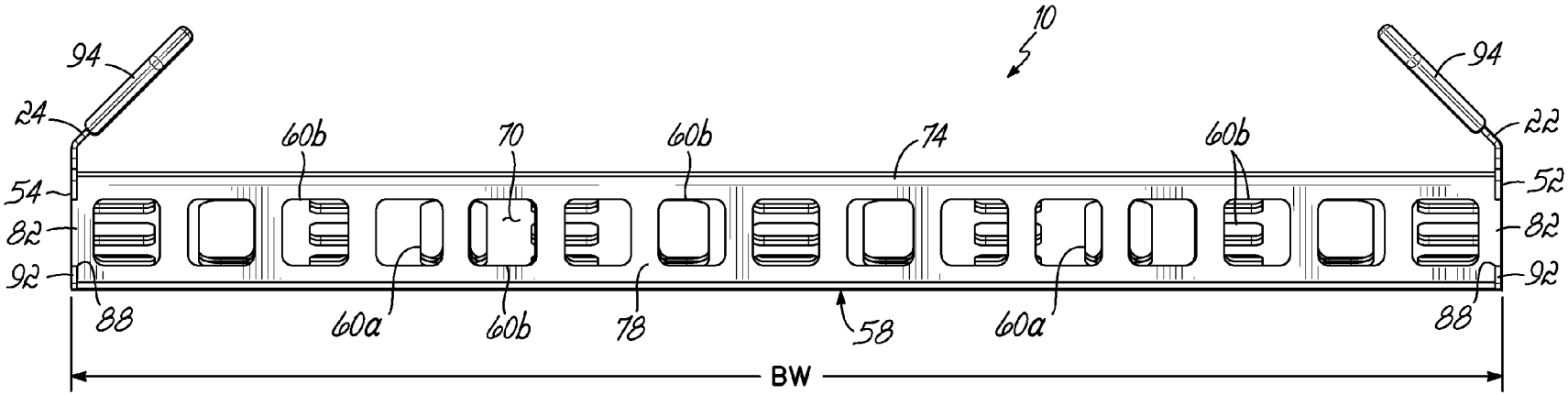
FIG. 11 is a rear side elevational view of the storage basket of FIG. 7.
Figure 12:
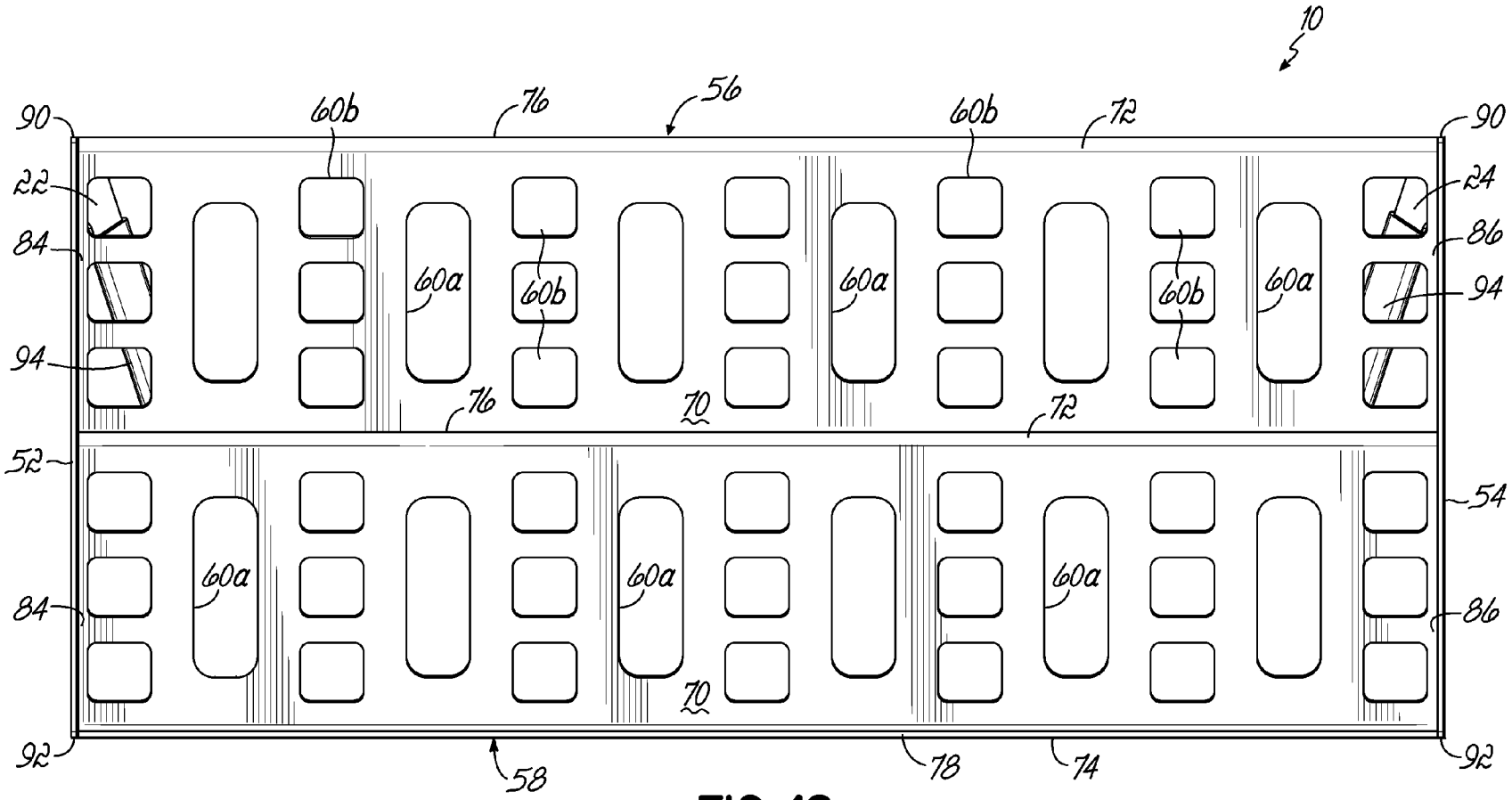
FIG. 12 is a bottom view of the storage basket of FIG. 7.

As shown in FIGS. 9 and 10, the first and second handles 22, 24 are effectively located along a handle axis HA that is angled from both a horizontal axis along the corresponding sidewall 52, 54 and a vertical plane running through the sidewall 52, 54. In the exemplary embodiment, for example, each of the handles 22, 24 may be angled about 45° from the vertical plane through the corresponding sidewall 52, 54 and angled about 25° from a horizontal axis along the corresponding sidewall 52, 54. It will be understood that the particular placement, angling and length of the first and second handles 22, 24 may be modified to enable easy grip in other embodiments where the freezer 12 and supporting shelves 16 are modified to provide a different amount of space for accessing the storage basket 10.

Figure 8:
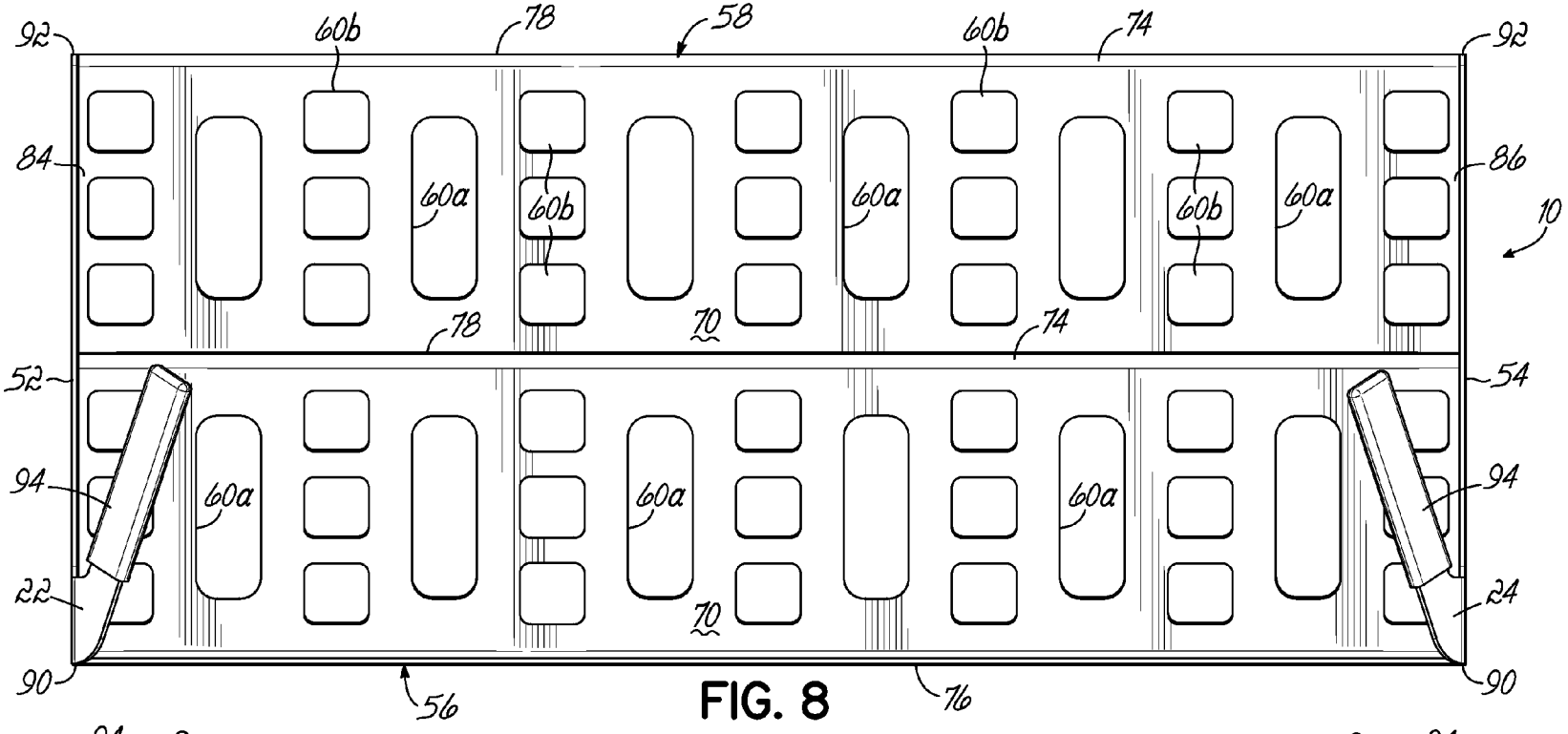
FIG. 8 is a top view of the storage basket of FIG. 7.

Another feature of the finalized storage basket 10 is the ability to fill substantially an entire supporting shelf 16 within the freezer 12 while maintaining substantial cooling air flow AF throughout the cabinet 18. As shown in FIG. 8, the storage basket 10 defines a "floor plan" including a basket width BW from the first sidewall 52 to the second sidewall 54 and a basket depth BD extending from the front wall 76 of the first inclined shelf 56 to the rear wall 78 of the second inclined shelf 58. The basket width BW and basket depth BD are sized in this embodiment to be nearly equal to a total cabinet width TCW and a total cabinet depth TCD of the supporting shelves 16 within the cabinet 18. In a specific example, the basket width BW may be about 32.25 inches and the basket depth BD may be about 14.10 inches when the internal cabinet dimensions (TCW by TCD) are about 33 inches by 15 inches. The storage basket 10 may be manufactured with a size closely corresponding to the cabinets 18 and freezers 12 in which the storage basket 10 will be used, and these specific dimensions may be altered without departing from the scope of the present invention. Therefore, the embodiment of the storage basket 10 shown in FIGS. 1 through 12 is configured to essentially completely fill one of the supporting shelves 16 inside the cabinet 18 of the freezer 12, which maximizes the amount of space used in the freezer 12.

Moreover, the cooling air flow AF is maintained throughout the freezer 12 as is evident from the views of the storage basket 10 shown in FIGS. 8, 9, 11 and 12. To this end, each of these top and bottom, front and rear views shows that a plurality of the air flow apertures 60*a*, 60*b* is always visible throughout the width and depth of the storage basket 10. More particularly, a substantial portion of the space encompassed by the storage basket 10 remains open for cooling air flow AF as a result of this arrangement of air flow apertures 60*a*, 60*b* throughout the first and second inclined shelves 56, 58 of the storage basket 10. The cooling air flow AF therefore moves throughout the cabinet 18 of the freezer 12 to efficiently and quickly cool the product units 14 positioned on the freezer 12 during operation.

As briefly discussed above, the partially coextensive positioning slots 88 in the center of each sidewall 52, 54 are located at slightly different elevations as a result of the rear wall 78 of the first inclined shelf 56 riding over and sitting on top of the second inclined shelf 58 adjacent to the front wall 76 thereof. In this regard, the positioning tabs 82 of the rear wall 78 of the first inclined shelf 56 and of the front wall 76 of the second inclined shelf 58 are located at slightly different elevations when the storage basket is assembled 10. These slightly different elevations of the positioning tabs 82 and the corresponding positioning slots 88 are shown most clearly in FIG. 10. However, it will be understood that the positioning slots 88 may be repositioned in order to place the first and second inclined shelves 56, 58 in different positions, as alluded to above, in other embodiments of the present invention. Although the particular design of the storage basket 10 shown in FIGS. 7 through 12 is considered to be advantageous for all of the reasons set forth above, the design may be modified to adjust for different types of freezers 12 and supporting shelves 16 in other embodiments.

Figure 13:
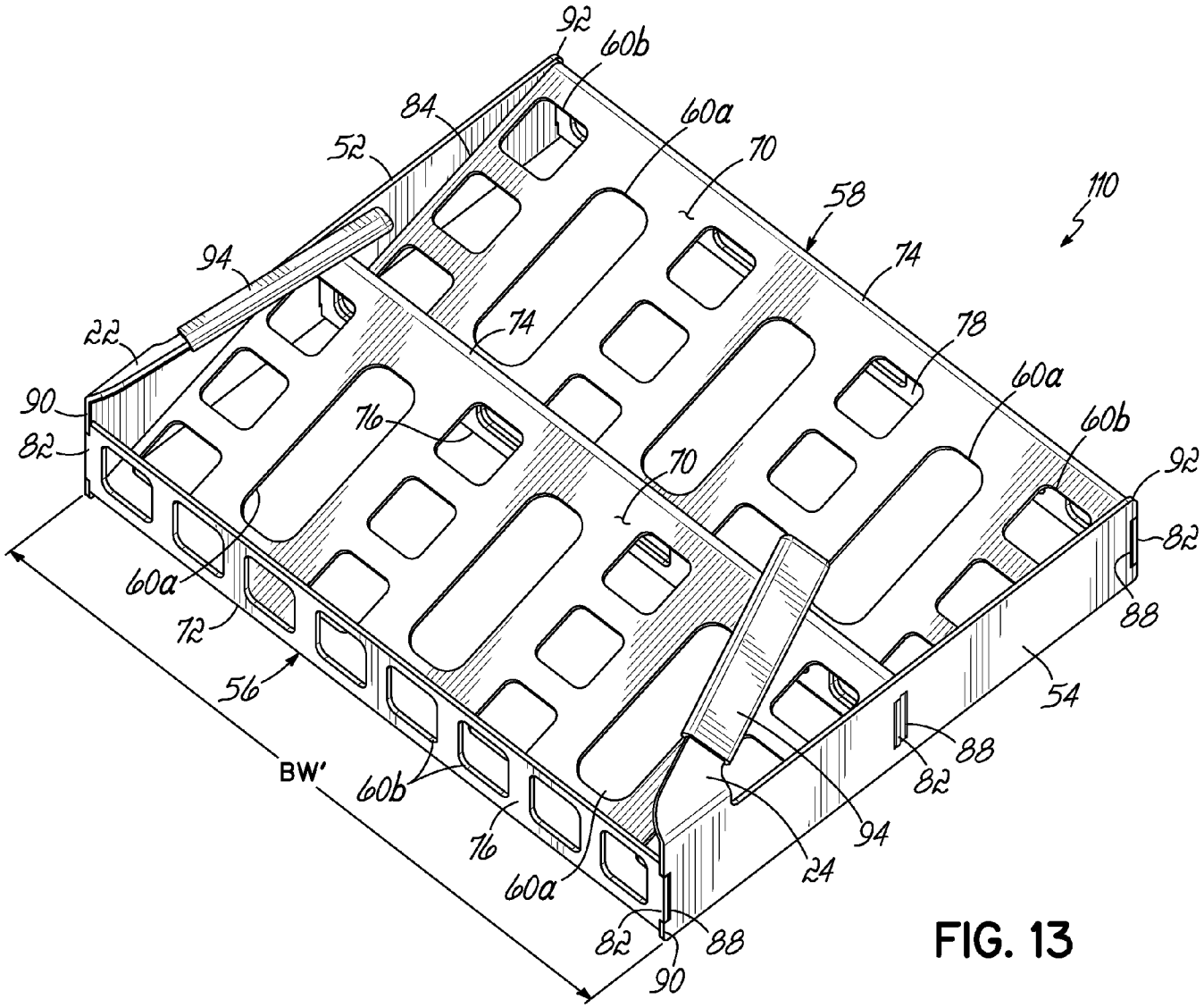
FIG. 13 is a perspective view of another embodiment of a storage basket for holding multiple product units in a freezer, the storage basket of this embodiment configured to hold fewer product units than the embodiment of FIGS. 1 through 12.
Figure 14:
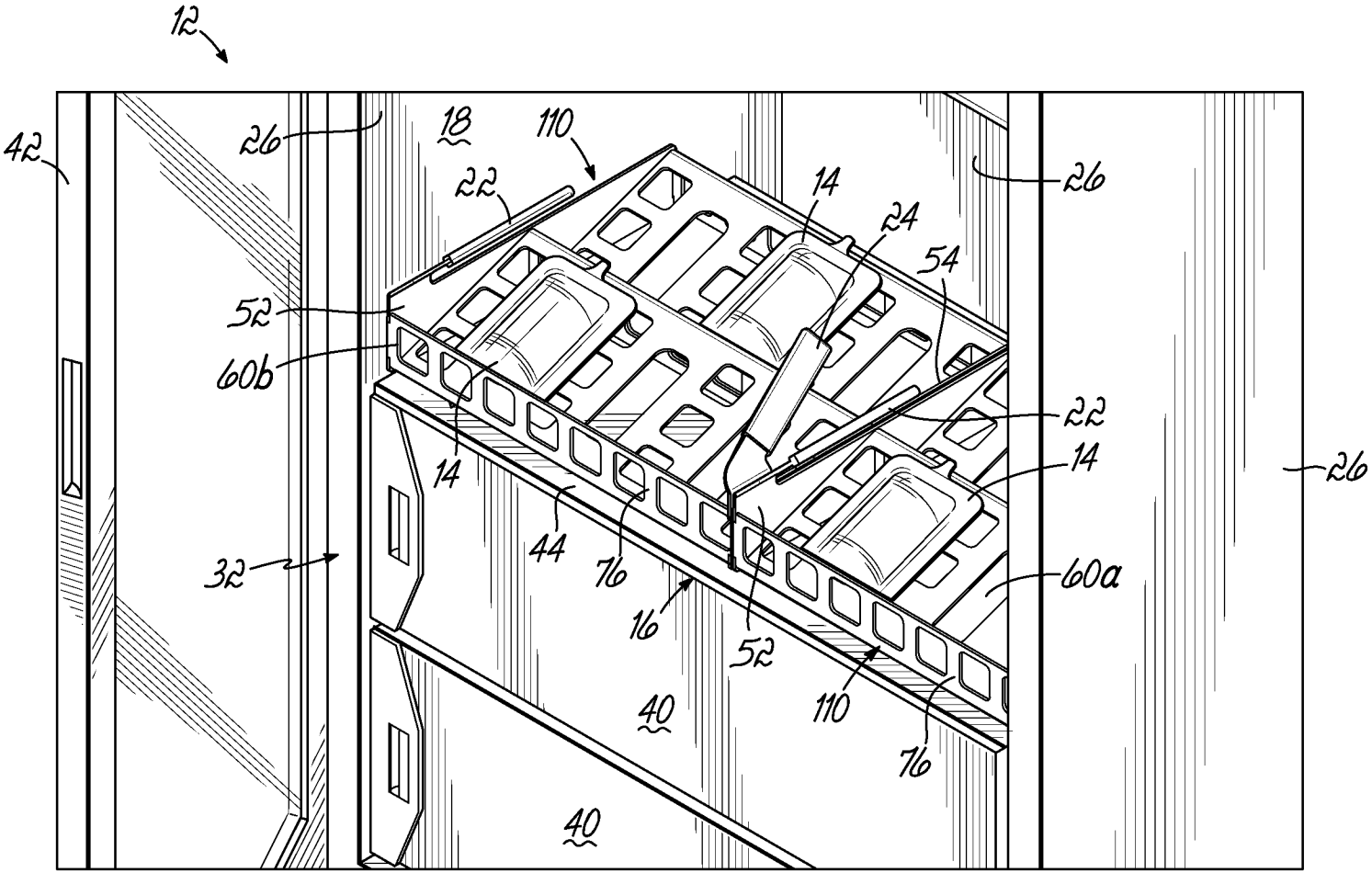
FIG. 14 is a perspective view of multiple storage baskets of FIG. 13 positioned on a supporting shelf within a cabinet of a freezer.

One example of such an alternative design is shown in FIGS. 13 and 14. This embodiment of the storage basket 110 is substantially identical to the first embodiment of FIGS. 1 through 12 except that the basket width BW' has been reduced to about half of the basket width BW of the first embodiment of the storage basket 10. All of the remaining elements of the storage basket 110, including the first and second sidewalls 52, 54 and the first and second inclined shelves 56, 58, remains the same as the previous embodiment and so the same reference numbers have been placed on these substantially identical elements. By shortening the basket width BW' in this embodiment, multiple storage baskets 110 may be used to fill the total cabinet width TCW of the cabinet 18. For example, when each of the storage baskets 110 is configured to be about half the size of the first embodiment baskets, then two of the storage baskets 110 may be positioned side-by-side on the supporting shelf 16 of the freezer 12 as shown in FIG. 14. The first and second handles 22, 24 continue to extend upwardly and inwardly from the corresponding first and second sidewalls 52, 54 such that the operator can access and grasp these handles 22, 24 of each of the storage baskets 110 without interference from adjacent storage baskets 110 of the insulated sidewalls 26.

As will be readily understood from this alternative embodiment of the storage basket 110, each of the storage baskets 110 now includes six receptacles for product units 14 defined by the first plurality of air flow apertures 60*a*. The second plurality of air flow apertures 60*b* may be resized, if necessary, to fit in rows of the second plurality of air flow apertures 60*b* between each pair of the first air flow apertures 60*a* and next to the first and second sidewalls 52, 54. It will be appreciated that the basket width BW' of the storage baskets 110 may be resized to any desirable width (e.g., to provide 3 storage baskets 110 per shelf, in one example) so long as the cooling air flow AF is still enabled throughout the cabinet 18 and so long as multiple receptacles are provided in each storage basket 110 to remove and insert multiple product units 14 at once. Consequently, the benefits of quick cooling and easy retrieval and replacement of product units 14 within a freezer 12 are maintained in this alternative design of the storage basket 110.

Figure 15:
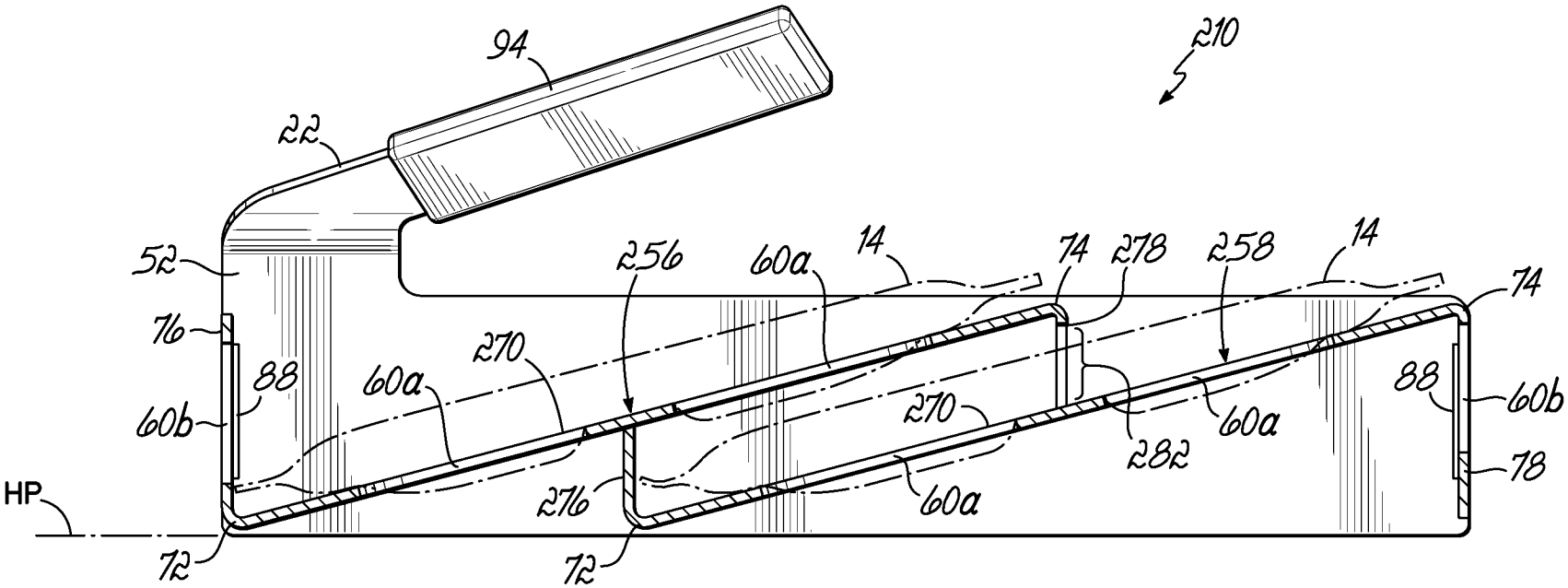
FIG. 15 is a cross sectional side view through the inclined shelves of another embodiment of a storage basket for holding multiple product units in a freezer, the storage basket of this embodiment including at least partially nested inclined shelves.

Another alternative embodiment of the storage basket 210 is shown in FIG. 15. In this alternative, the storage basket 210 defines longer storage spaces formed by providing nesting of the first and second inclined shelves 256, 258 rather than having an abutting relation between those first and second inclined shelves 256, 258. In this embodiment, modified elements are provided with new reference numbers in the 200 series, while identical elements to the first two embodiments are provided with the same reference numbers as above. As shown in FIG. 15, each of the first and second inclined shelves 256, 258 is modified to define a longer length along the inclined shelf surface 270. In addition, the rear wall 278 of the first inclined shelf 256 is modified (the front wall 76 stays the same) and the front wall 276 of the second inclined shelf 258 is also modified (the rear wall 78 stays the same).

In this regard, the rear wall 278 of the first inclined shelf 256 is mostly removed except at the lateral side edges 84, 86 where positioning tabs 282 are located. The modified positioning tabs along this rear wall 278 are inserted into positioning slots (not shown) which are also moved to a different location on the first and second sidewalls 52, 54. This mostly-open rear wall 278 thereby opens access for product units 14 to be positioned between the rear edge 74 of the inclined shelf surface 270 of the first inclined shelf 256 and the inclined shelf surface 270 of the second inclined shelf 258. The inclined shelf surface 270 of the second inclined shelf 258 therefore tucks at least partially underneath the inclined shelf surface 270 of the first inclined shelf 256, thereby providing "nesting" of the first and second inclined shelves 256, 258.

The front wall 276 of the second inclined shelf 258 is located underneath the inclined shelf surface 270 of the first inclined shelf 256. In addition, this front wall 276 is located forward from the rear edge 74 of the inclined shelf surface 270 of the first inclined shelf 256. Unlike the rear wall 278 of the first inclined shelf 256, the front wall 276 of the second inclined shelf 258 remains largely the same as the front wall 76 of the first inclined shelf 256 so that this front wall 276 continues to block sliding movement of product units 14 off of the second inclined shelf 258. The front wall 276 of the second inclined shelf 258 includes some of the second plurality of air flow apertures 60*b* as well. Optionally, the first plurality of air flow apertures 60*a* may be divided into pairs for each product unit 14 such that the rigid edge of the front wall 276 of the second inclined shelf 258 is blocked from direct engagement with the product units 14. This division of the first plurality of air flow apertures 60*a* is shown in FIG. 15, but it will be appreciated that the shape and size of these apertures 60*a* remains distinct from the apertures 60*b*. The front wall 276 of the second inclined shelf 258 also includes modified positioning tabs that are inserted and fixed to modified positioning slots in the sidewalls 52, 54.

As a result of these modifications to the storage basket 210, product units 14 or blood bags 14 having a longer length may be positioned on the receptacles defined by the storage basket 210. Consequently, storage density of longer product units 14 on the supporting shelves 16 of the freezer 12 is further enhanced in this embodiment. It will be understood that the positioning and nesting of the first and second inclined shelves 256, 258 may be further modified to fit the needs of a particular operator, such as for use with different uniquely-sized product units 14 in different fields. However, each of these alternatives would still enable rapid cooling air flow AF movement throughout a cabinet 18 while increasing the storage density in a freezer 12 and enabling quicker retrieval and replacement of product in the freezer 12. Therefore, the storage basket 210 of this embodiment provides similar advantages as the previously-described embodiments.

In each of these embodiments of the storage basket 10, 110, 210, an operator is able to position multiple product units 14 on the plurality of inclined shelves 56, 58 at the sites denoted as storage receptacles by the first plurality of air flow apertures 60*a*. The operator then moves the storage basket 10, 110, 210 using the handles 22, 24 into the cabinet 18 of the freezer 12 as a unit, this simultaneous insertion of product units 14 reducing the time that a door(s) 40, 42 of the freezer 12 is opened. Once the operator closes the door(s) 40, 42, the cooling air flow AF generated within the cabinet 18 is able to flow freely through the storage baskets 10, 110, 210 and the supporting shelves 16 to thereby rapidly cool the product units 14 back to a frozen or ultra-low temperature, depending on the particular needs of the operator. Furthermore, the retrieval of a product unit 14 is also simplified by enabling the operator to retrieve an entire storage basket 10, 110, 210 at once rather than search for a particular bag while waiting with the door(s) 40, 42 of the freezer 12 opened. Accordingly, the use of the storage baskets 10, 110, 210 described in connection with the present invention improves the cooling efficiency of known freezers 12 used to store bodily fluids and other types of product units 14.

While the present invention has been illustrated by the description of exemplary embodiments thereof, and while these embodiments have been described in considerable detail, these are not intended to restrict or in any way limit the scope of the appended claims to such detail. Additional advantages and modifications will readily appear to those skilled in the art. For example, more than two inclined shelves may be provided on each storage basket in other embodiments. The present invention in its broader aspects is therefore not limited to the specific details, representative apparatus and method and illustrative examples shown and described. Accordingly, departures may be from such details without departing from the scope or spirit of the general inventive concept.

What is claimed is:

1. A storage basket for holding multiple product units inside a freezer, the freezer including a cabinet communicating with a cooling air flow and having a plurality of supporting shelves configured to enable the cooling air flow to move within the cabinet, the storage basket comprising:

first and second spaced-apart sidewalls;

a plurality of inclined shelves extending between and operatively coupled to the first and second sidewalls, the plurality of inclined shelves being configured to support the multiple product units thereon and being oriented at an acute angle relative to a horizontal plane; and at least one handle for permitting manual grasping of the storage basket during movement of the storage basket into and out of the freezer, wherein the plurality of inclined shelves include a plurality of air flow apertures configured to enable the cooling air flow in the cabinet to move around and through the storage basket and around the multiple product units when the storage basket is located in the freezer, and wherein each of the plurality of inclined shelves further comprises:

an inclined shelf surface that is generally planar and is configured to support the multiple product units thereon, the inclined shelf surface defining a front edge and a rear edge;

a front wall that is generally planar and extends upwardly from adjacent the front edge of the inclined shelf surface and positioned to prevent the multiple product units from sliding off of the inclined shelf surface; and a rear wall that is generally planar and extends downwardly from adjacent the rear edge of the inclined shelf surface.

2. The storage basket of claim 1, wherein the at least one handle includes first and second handles positioned proximate to the first and second sidewalls, respectively.

3. The storage basket of claim 2, wherein the first and second handles extend upwardly from the respective first and second sidewalls and also extend inwardly from the respective first and second sidewalls so as to overlie at least one of the plurality of inclined shelves.

4. The storage basket of claim 1, wherein each of the first and second sidewalls includes positioning slots configured to be located adjacent the front wall and the rear wall of each of the plurality of inclined shelves, and each of the plurality of inclined shelves further comprises:

positioning tabs projecting outwardly from the front wall and from the rear wall, the positioning tabs being inserted into the positioning slots in the first and second sidewalls when the plurality of inclined shelves is operatively coupled to the first and second sidewalls.

5. The storage basket of claim 4, wherein the first and second sidewalls and the plurality of inclined shelves are formed from punched sheets of metal, and wherein the positioning tabs on the plurality of inclined shelves are fastened to the first and second sidewalls at the positioning slots to fix the plurality of inclined shelves in position relative to the first and second sidewalls.

6. The storage basket of claim 1, wherein the plurality of air flow apertures includes a first plurality of air flow apertures and a second plurality of air flow apertures defining at least one of a shape or size that is different than the first plurality of air flow apertures, such that the first plurality of air flow apertures are sized to indicate receptacle locations that receive an individual unit of the multiple product units.

7. The storage basket of claim 6, wherein each individual unit comprises a bag for receiving fluid samples, and further wherein the first plurality of air flow apertures are each shaped to receive a projecting portion of a respective bag such that, when fluid inside the bag freezes, and the projecting portion in the shape of the first plurality of air flow apertures becomes visible on the bag when flipped over, thereby visually confirming the frozen state of fluid inside the bag.

8. The storage basket of claim 6, wherein each of the receptacle locations defined by the first plurality of air flow apertures is separated from other receptacle locations by one or more of the second plurality of air flow apertures, thereby ensuring that the cooling air flow passes between and around all sides of each of the multiple product units positioned on the storage basket.

9. The storage basket of claim 1, wherein the storage basket is configured to be placed within a freezer defining a total cabinet width, and wherein the plurality of inclined shelves is dimensioned with a basket width substantially equal to the total cabinet width.

10. The storage basket of claim 1, wherein the storage basket is configured to be placed within a freezer defining a total cabinet width, and wherein the plurality of inclined shelves is dimensioned with a basket width smaller than the total cabinet width so that multiple storage baskets may be used side-by-side.

11. A storage basket for holding multiple product units inside a freezer, the freezer including a cabinet communicating with a cooling air flow and having a plurality of supporting shelves configured to enable the cooling air flow to move within the cabinet, the storage basket comprising:

first and second spaced-apart sidewalls;

a plurality of inclined shelves extending between and operatively coupled to the first and second sidewalls, the plurality of inclined shelves being configured to support the multiple product units thereon and being oriented at an acute angle relative to a horizontal plane; and at least one handle for permitting manual grasping of the storage basket during movement of the storage basket into and out of the freezer, wherein the plurality of inclined shelves include a plurality of air flow apertures configured to enable the cooling air flow in the cabinet to move around and through the storage basket and around the multiple product units when the storage basket is located in the freezer, wherein each of the plurality of inclined shelves further comprises:

an inclined shelf surface configured to support the multiple product units thereon, the inclined shelf surface defining a front edge and a rear edge;

a front wall extending upwardly from adjacent the front edge of the inclined shelf surface and positioned to prevent the multiple product units from sliding off of the inclined shelf surface; and a rear wall extending downwardly from adjacent the rear edge of the inclined shelf surface, and wherein the plurality of inclined shelves includes a first inclined shelf and a second inclined shelf positioned rearward of the first inclined shelf, and wherein the rear wall of the first inclined shelf is in abutting contact with the front wall of the second inclined shelf when the first and second inclined shelves are operatively coupled to the first and second sidewalls.

12. The storage basket of claim 11, wherein the rear wall of the first inclined shelf rides over the front wall of the second inclined shelf when the first and second inclined shelves are operatively coupled to the first and second sidewalls, thereby positioning the rear wall of the first inclined shelf rearward of the front wall of the second inclined shelf.

13. A storage basket for holding multiple product units inside a freezer, the freezer including a cabinet communicating with a cooling air flow and having a plurality of supporting shelves configured to enable the cooling air flow to move within the cabinet, the storage basket comprising:

first and second spaced-apart sidewalls;

a plurality of inclined shelves extending between and operatively coupled to the first and second sidewalls, the plurality of inclined shelves being configured to support the multiple product units thereon and being oriented at an acute angle relative to a horizontal plane; and at least one handle for permitting manual grasping of the storage basket during movement of the storage basket into and out of the freezer, wherein the plurality of inclined shelves include a plurality of air flow apertures configured to enable the cooling air flow in the cabinet to move around and through the storage basket and around the multiple product units when the storage basket is located in the freezer, and wherein the plurality of inclined shelves includes a first inclined shelf and a second inclined shelf, each further comprising:

an inclined shelf surface configured to support the multiple product units thereon, the inclined shelf surface defining a front edge and a rear edge; and a front wall extending upwardly from adjacent the front edge of the inclined shelf surface and positioned to prevent the multiple product units from sliding off of the inclined shelf surface, wherein the first and second inclined shelves are at least partially nested by positioning the front wall and the front edge of the second inclined shelf underneath the inclined shelf surface of the first inclined shelf and forward from the rear edge of the first inclined shelf, thereby positioning at least a portion of the multiple product units located on the second inclined shelf directly underneath at least a portion of the multiple product units located on the first inclined shelf.

14. A storage basket for holding multiple product units inside a freezer, the freezer including a cabinet communicating with a cooling air flow and having a plurality of supporting shelves configured to enable the cooling air flow to move within the cabinet, the storage basket comprising:

first and second spaced-apart sidewalls; and a plurality of inclined shelves extending between and operatively coupled to the first and second sidewalls, the plurality of inclined shelves including an inclined shelf surface that is generally planar, is configured to support the multiple product units thereon, and is oriented at an acute angle relative to a horizontal plane;

wherein the plurality of inclined shelves include a plurality of air flow apertures configured to enable the cooling air flow in the cabinet to move around and through the storage basket and around the multiple product units when the storage basket is located in the freezer, and wherein the plurality of air flow apertures includes a first plurality of air flow apertures and a second plurality of air flow apertures defining at least one of a shape or size that is different than the first plurality of air flow apertures, such that the first plurality of air flow apertures are sized to indicate receptacle locations that receive an individual unit of the multiple product units, and the generally planar inclined shelf surface includes apertures from both the first plurality of air flow apertures and the second plurality of air flow apertures.

15. The storage basket of claim 14, wherein each individual unit comprises a bag for receiving fluid samples, and further wherein the first plurality of air flow apertures are each shaped to receive a projecting portion of a respective bag such that, when fluid inside the bag freezes, and the projecting portion in the shape of the first plurality of air flow apertures becomes visible on the bag when flipped over, thereby visually confirming the frozen state of fluid inside the bag.

16. The storage basket of claim 14, wherein the first and second pluralities of air flow apertures are arranged on the plurality of inclined shelves such that when the multiple product units are placed onto the first plurality of air flow apertures and when the storage basket is placed into the freezer, the second plurality of air flow apertures remains uncovered by the multiple product units to enable the cooling air flow to freely flow around all sides of the multiple product units.

17. A storage basket for holding multiple product units inside a freezer, the freezer including a cabinet communicating with a cooling air flow and having a plurality of supporting shelves configured to enable the cooling air flow to move within the cabinet, the storage basket comprising:

first and second spaced-apart sidewalls; and a plurality of inclined shelves extending between and operatively coupled to the first and second sidewalls, the plurality of inclined shelves being configured to support the multiple product units thereon and being oriented at an acute angle relative to a horizontal plane;

wherein the plurality of inclined shelves include a plurality of air flow apertures configured to enable the cooling air flow in the cabinet to move around and through the storage basket and around the multiple product units when the storage basket is located in the freezer, and wherein the plurality of air flow apertures includes a first plurality of air flow apertures and a second plurality of air flow apertures defining at least one of a shape or size that is different than the first plurality of air flow apertures, such that the first plurality of air flow apertures are sized to indicate receptacle locations that receive an individual unit of the multiple product units, and wherein each of the receptacle locations defined by the first plurality of air flow apertures is separated from other receptacle locations by one or more of the second plurality of air flow apertures, thereby ensuring that the cooling air flow passes between each of the multiple product units positioned on the storage basket.

18. A method of storing multiple product units inside a freezer, the freezer including a cabinet communicating with a cooling air flow and having a plurality of supporting shelves configured to enable the cooling air flow to move within the cabinet, the method comprising:

positioning multiple product units onto a plurality of inclined shelves of a storage basket, the storage basket also including first and second sidewalls and at least one handle for permitting manual grasping of the storage basket;

moving the storage basket into the cabinet of the freezer and onto one of the plurality of supporting shelves such that all of the multiple product units on the storage basket are simultaneously inserted into the freezer, the plurality of inclined shelves being oriented at an acute angle relative to a horizontal plane; and closing a door that provides access into the cabinet after moving the storage basket onto the corresponding supporting shelf, thereby enabling the cooling air flow to rapidly cool the multiple product units by flowing through the plurality of supporting shelves and by flowing through a plurality of air flow apertures provided in the storage basket, wherein the plurality of air flow apertures in the storage basket includes first and second pluralities of air flow apertures, the first plurality of air flow apertures defining receptacle locations for receiving individual bags containing fluid samples, and the method further comprises:

laying the bags containing fluid samples onto the receptacle locations such that a projecting portion of the bags extends into the first plurality of air flow apertures; and flipping the bags over to determine if the projecting portion of the bags remains visible, which indicates that fluid inside the bags is frozen.

19. A method of storing multiple product units inside a freezer, the freezer including a cabinet communicating with a cooling air flow and having a plurality of supporting shelves configured to enable the cooling air flow to move within the cabinet, the method comprising:

positioning multiple product units onto a plurality of inclined shelves of a storage basket, the storage basket also including first and second sidewalls and at least one handle for permitting manual grasping of the storage basket;

moving the storage basket into the cabinet of the freezer and onto one of the plurality of supporting shelves such that all of the multiple product units on the storage basket are simultaneously inserted into the freezer, the plurality of inclined shelves being oriented at an acute angle relative to a horizontal plane; and closing a door that provides access into the cabinet after moving the storage basket onto the corresponding supporting shelf, thereby enabling the cooling air flow to rapidly cool the multiple product units by flowing through the plurality of supporting shelves and by flowing through a plurality of air flow apertures provided in the storage basket, wherein the plurality of air flow apertures in the storage basket includes first and second pluralities of air flow apertures, the second plurality of air flow apertures defining at least one of a shape or size that is different than the first plurality of air flow apertures, the first plurality of air flow apertures defining receptacle locations separated from one another by one or more of the second plurality of air flow apertures, and the method further comprises:

placing the multiple product units containing fluid samples onto the receptacle locations, thereby exposing top and bottom sides of the multiple product units to the cooling air flow when the storage basket is placed into the freezer; and leaving the second plurality of air flow apertures uncovered by the multiple product units to enable the cooling air flow to freely flow through the plurality of inclined shelves and around all sides of the multiple product units when the storage basket is placed into the freezer.

20. The method of claim 19, further comprising:

assembling the storage basket from the first and second sidewalls and the plurality of inclined shelves by performing the following steps:

aligning positioning tabs projecting from front and rear walls of the plurality of inclined shelves with positioning slots formed in the first and second sidewalls;

inserting the positioning tabs through the positioning slots in the first and second sidewalls; and fixing the positioning tabs to the first and second sidewalls at the positioning slots to couple the plurality of inclined shelves into position so as to extend between the first and second sidewalls.

* * * * *